US005849112A

United States Patent [19]

El-Soudani

[11] Patent Number: 5,849,112

[45] Date of Patent: Dec. 15, 1998

[54] THREE PHASE α-β TITANIUM ALLOY MICROSTRUCTURE

[75] Inventor: Sami M. El-Soudani, Cerritos, Calif.

[73] Assignee: Boeing North American, Inc., Seal Beach, Calif.

[21] Appl. No.: 771,366

[22] Filed: Dec. 16, 1996

Related U.S. Application Data

[62] Division of Ser. No. 339,856, Nov. 15, 1994, Pat. No. 5,698,050.

[51] Int. Cl.[6] ..... C22C 14/00

[52] U.S. Cl. ..... 148/421; 420/418; 420/419; 420/420

[58] Field of Search ..... 148/421; 420/417–418, 420/419, 420

[56] References Cited

U.S. PATENT DOCUMENTS

| | | | |
|---|---|---|---|
| 3,901,743 | 8/1975 | Sprague et al. | 148/133 |
| 4,631,092 | 12/1986 | Ruckle et al. | 148/3 |
| 4,802,930 | 2/1989 | Kessler | 148/12.7 |
| 4,889,170 | 12/1989 | Mae et al. | 148/407 |
| 4,975,125 | 12/1990 | Chakrabarti et al. | 148/12.7 |
| 5,232,661 | 8/1993 | Matsuo et al. | 420/421 |
| 5,281,285 | 1/1994 | Marquardt | 148/670 |
| 5,326,409 | 7/1994 | Couts, Jr. | 148/631 |
| 5,332,454 | 7/1994 | Meredith et al. | 148/421 |
| 5,348,702 | 9/1994 | Matsuo et al. | 420/421 |

*Primary Examiner*—John Sheehan
*Attorney, Agent, or Firm*—Lawrence N. Ginsberg; Terrell P. Lewis

[57] ABSTRACT

The invention is a process for simultaneously improving at least two mechanical properties of mill-processed (α+β) titanium alloy, which may or may not contain silicon, which includes steps of heat treating the mill-processed titanium alloy such that the (α+β) microstructure of said alloy is transformed into an ($\alpha+\alpha_2+\beta$) microstructure, preferably containing no silicides. The heat treating steps involve subjecting the mill-processed titanium alloy to a sequence of thermomechanical process steps, and the mechanical properties which are simultaneously improved include (a) tensile strength at room, cryogenic, and elevated temperatures; (b) fracture toughness; (c) creep resistance; (d) elastic stiffness; (e) thermal stability; (f) hydrogen embrittlement resistance; (g) fatigue; and (h) cryogenic temperature embrittlement resistance. As a consequence of the process, the ($\alpha+\alpha_2+\beta$) microstructure contains equiaxed alpha phase strengthened with $\alpha_2$ precipitates coexisting with lamellar alpha-beta phase, where the $\alpha_2$ precipitates are confined totally to the equiaxed primary alpha phase. The invention also encompasses a composition of matter produced by the inventive process, especially one comprising a titanium alloy having an ($\alpha+\alpha_2+\beta$) microstructure.

2 Claims, 27 Drawing Sheets

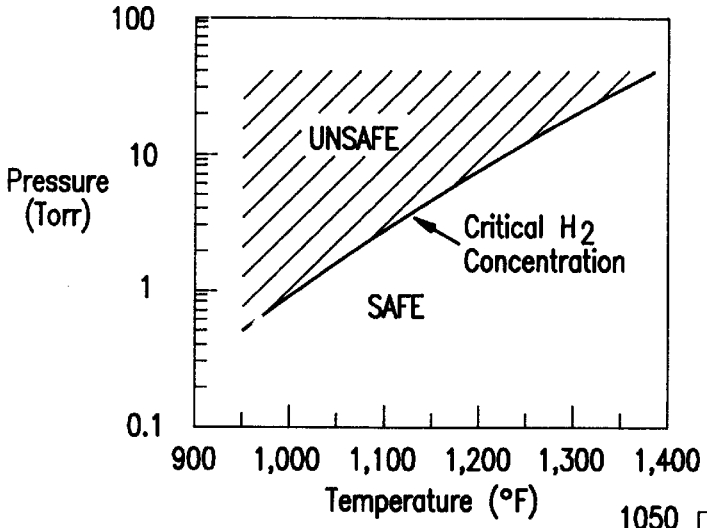
FIG. 1
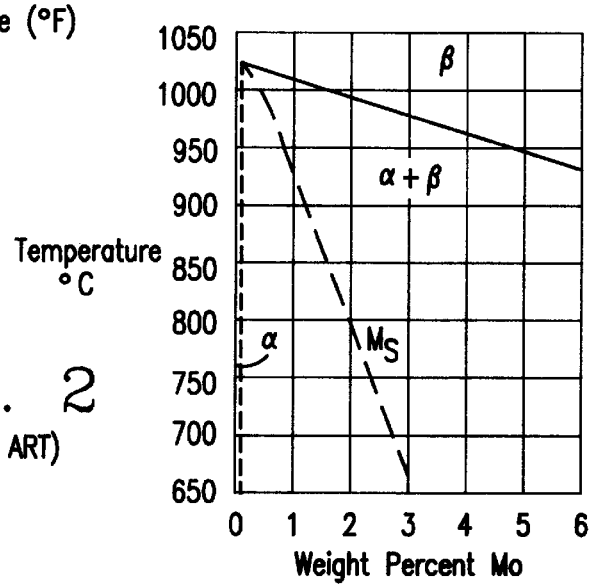
FIG. 2
(PRIOR ART)
FIG. 3
(PRIOR ART)
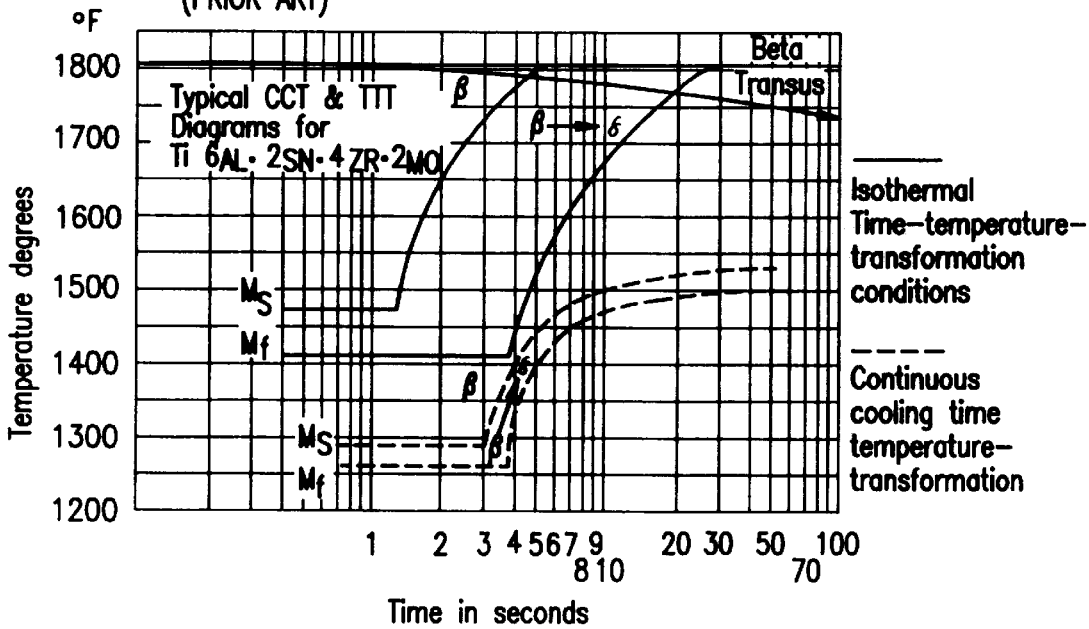

THREE PHASE α-β TITANIUM ALLOY MICROSTRUCTURE

This is a divisional of application Ser. No. 08/339,856 filed on Nov. 15, 1994 now U.S. Pat. No. 5,698,050.

BACKGROUND OF THE INVENTION

1. Field of the Invention

The present invention relates to methods for processing titanium alloys for improving physical properties, and more particularly to a novel method for processing rolled alpha-beta titanium alloys to achieve simultaneous improvements in such properties as tensile strength, elastic modulus, fracture toughness, thermal stability and resistance to catastrophic fracture under cryogenic temperature, hydrogen embrittlement and creep deformation.

2. Description of the Related Art

The high performance technologies of the future will impose increasing demands on new improved light weight, high strength materials, such as titanium alloys.

One area of interest is high speed civil transport (HSCT). The main focus of HSCT is to upgrade proposed aircraft structures to be compatible with Mach 2.4 vehicle requirements for the purpose of replacing or upgrading the existing Concorde Mach 2.0 technology.

Currently, HSCT emphasis is on the use of titanium alloys because, under Mach 2.4 conditions, they exhibit damage tolerance and durability, as well as thermal stability, with an expected 72,000 hours at supersonic cruise temperatures of about 350° F. throughout one airplane lifetime.

At such temperatures, virtually all heat treatable aluminum alloys experience aging degradation of critical properties, such as fracture toughness, with prolonged duration of service exposure.

The outcome of recent investigations suggests that the maximum use temperature for the most advanced aluminum-lithium alloys is about 225° F. This conclusion inevitably minimizes the use of aluminum alloys as outer skins and associated structures. If a similar conclusion is drawn for non-metallic composites, then only titanium alloys would remain as the sole candidate material system for such high temperature, long life applications.

On the other hand, severe goal property requirements have been imposed on titanium alloys by major aircraft vehicle contractors (see Table 1 below). As yet, these requirements remain beyond reach by all of the current state-of-the-art titanium alloys.

TABLE 1

Titanium Alloy Property Goals for Mach 2.4 High Speed Civil Transport (HSCT) Vehicles

| Alloy Type | Applicable Product Forms | Ultimate Tensile Strength [ksl] | Fracture Toughness* Kapp [ksl, √inch] | Fracture Toughness* KIC [ksl, √inch] | Elastic Tension Modulus [Msl] | Density [lbs/cubic Inch] |
|---|---|---|---|---|---|---|
| High-Strength Alloy Goal Requirement | Foll, Strip, Sheet, Plate, Forging, Extrusion | 210 | 100 | 60 | 16.0 | 0.167 |
| High-Toughness Alloy Goal Requirement | Fall, Strip, Sheet, Plate, Forging, Extrusion | 165 | 190 | 95 | 16.5 | 0.162 |
| High-Modulus Alloy Goal Requirement | Strip, Sheet, Plate, Extrusion | 145 | 160 | 80 | 19.5 | 0.159 |

*Kscc and Kiscc shall be >= 80% of Kapp and KIC, respectively.

Another area of potential application of titanium alloys, which provided incentive for the development of the invention, is hypersonic vehicle structures, including use for both military and space flight research vehicles.

Hypersonic vehicle airframe structures are expected to be subject to hydrogen concentrations and partial pressures caused largely by hydrogen leaks within the vehicle airframe cavities through system valves and pressurized fuel transport lines. While the safety limit for "casual" hydrogen pressure build-up is currently set at 4 volume percent (thereby precluding explosive combustion), it has been shown that unless certain material processing measures are taken, concentration levels well below the safety limit may still cause severe hydrogen embrittlement of basic candidate titanium alloy systems. Hypervelocity-vehicle titanium structures absorb critical amounts of low pressure casual hydrogen generated by such anticipated fuel supply system leaks. As a result, improperly heat-treated titanium airframe structures will exhibit severely embrittled behavior manifested by their reduced room-temperature tensile ductility. The critical hydrogen concentration for any given alloy depends on a combination of hydrogen pressure and temperature at which the material is charged. This situation is depicted schematically in FIG. 1, which outlines the window of safe operating conditions for maximum use temperatures. In that situation, the severity of hydrogen embrittlement following a given duration of exposure at a specific temperature and hydrogen pressure is quantified in terms of the extent of degradation in smooth bar tensile elongation. Should the post-exposure value of tensile ductility drop below the minimum required value of 2%, the associated charging conditions as well as the equivalent service exposure would be considered excessive or "unsafe" for hypersonic vehicle operation.

Other areas where high performance titanium alloys are required are:

(a) high temperature usage, other than hydrogen-fueled hypersonic applications, such as miscellaneous aircraft engine and missile casings and heat shield applications, and (b) armor plates resisting ballistic impact, and shields protecting critical structures, such as avionics packages and electronic systems, from foreign object damage (FOD).

Substantial weight reductions and more efficient system performances have been achieved through replacements of the heavier superalloys with titanium in (a), while definite promise lies ahead upon successful replacements of both monolithic hardened steel and aluminum laminate sheet stock from structural armor plates.

These current needs for advanced titanium development are by no means all inclusive. In combination, however, they pose a serious challenge for alloy developers in that they require simultaneous improvements in the following properties:

(a) tensile strength (at room, cryogenic and elevated temperatures);

(b) fracture toughness;

(c) creep resistance;

(d) elastic stiffness (Young's Modulus);

(e) thermal stability;

(f) hydrogen embrittlement resistance; and (g) low cycle fatigue.

The often observed natural trends in most material systems are such that enhancement of certain material properties (e.g. tensile strength) is associated with a substantial reduction in some other property (e.g., fracture toughness). Similarly, creep resistance can be enhanced by the introduction of ordering transformations (e.g., inter-metallic compounds). These alloy systems, however, are generally quite deficient in terms of fracture toughness and tensile ductility. Many other examples can be cited where the improvement of one property invariably leads to degradation of another of the same alloy.

Given these trade-off tendencies, researchers have been mostly achieving only partially improved property balances through alloy processing optimization steps.

OBJECTS AND SUMMARY OF THE INVENTION

It is, therefore, a principal object of the present invention to provide a novel method for simultaneously improving at least two mechanical properties, taken from the group of properties comprising tensile strength, fracture toughness, creep resistance, elastic stiffness, thermal stability, hydrogen embrittlement resistance, and low cycle fatigue, of mill-processed ($\alpha+\beta$) titanium alloy by heat treating the alloy such that the ($\alpha+\beta$) microstructure is transformed into an ($\alpha+\alpha_2+\beta$) microstructure.

Another object of the present invention is to provide a process for transforming the ($\alpha+\beta$) microstructure of mill-processed titanium alloys into an ($\alpha+\alpha_2+\alpha$) microstructure consisting of equiaxed alpha phase strengthened with $\alpha_2$ precipitates coexisting with lamellar alpha-beta phase, and the 02 precipitates being confined totally to the equiaxed primary alpha phase.

Still another object of the invention is to provide a novel titanium alloy having an ($\alpha+\alpha_2+\beta$) microstructure.

Yet another object of the invention is to provide a composition of matter having an ($\alpha+\alpha_2+\beta$) microstructure consisting of equiaxed alpha phase strengthened with $\alpha_2$ precipitates coexisting with lamellar alpha-beta phase where the $\alpha_2$ precipitates are confined totally to the equiaxed primary alpha phase.

BRIEF DESCRIPTION OF THE DRAWINGS

FIG. 1 is a schematic illustration of hydrogen threshold for safe operation of a hypersonic vehicle subject to casual hydrogen;

FIG. 2 is a pseudo binary equilibrium phase diagram for (Ti-6Al-2Sn-4Zr)-XMo for values of molybdenum content in Wt. % between 0 and 6 (Prior Art).

FIG. 3 shows isothermal "TTT" and continuous cooling "CCT" transformation-time-temperature diagrams for Ti-6Al-2Sn-4Zr-2Mo alloy (Prior Art).

DETAILED DESCRIPTION OF THE PREFERRED EMBODIMENTS

Figure 4:
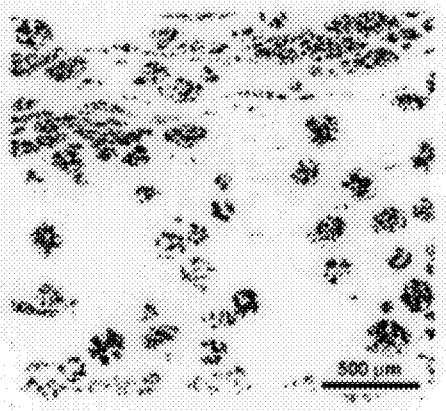
FIG. 4 shows the microstructure of thermally exposed phase blended gamma titanium aluminide Ti-48Al-2.5Nb-0.3Ta [at. %] mixed with 20 volume % [Ti-30Nb] at. % held at 1950° F. for 10 minutes (magnification of 50 times).

The standard methods recommended for heat treating titanium alloys, such as Ti-6242S sheet (which will be referred to throughout the text as an exemplary, "demonstrator", alloy), fall into two defined categories: MIL-H-81200B, which is a heat treatment specification conforming with military requirements, and AMS 4919B, which is an Aerospace Material Specification for many procurement documents.

The MIL-H-81200B Standard recommends several broad categories of heat treat sequences, as follows:

(a) Solution Treat and Age (Alpha-Beta STA)
For Sheet, Strip, and Plate:
Heat to (1500–1675)° F., hold for 2 to 90 minutes, air cool, then heat to (1050–1150)° F. hold for 2 to 8 hours, cool in either air, an inert gas, or a furnace.
For Bars, Forgings, and Castings:
Heat to (1650–1800)° F., hold for 20 to 120 minutes, air cool, then heat up to (1050–1150)° F., hold for 2 to 8 hours, cool in air, inert gas or furnace.

(b) Anneal and Stabilize (Alpha-Beta & Duplex Anneal)
For Sheet, Strip and Plate:
Heat up to (1600–1700)° F., hold sheet for 10 to 60 minutes or plate for 30 to 120 minutes, air cool, then heat up to 1450° F., hold for 15 minutes and air cool for sheet, or heat up to 1100° F., hold for 8 hours, and air cool for plate.

The foregoing heat treatment for sheet, strip, and plate is virtually similar to that required per AMS 4919B, which makes a finer distinction between heat treatments for sheet and plate, as follows:

(a) Product less than 0.1875 in. in nominal thickness shall be heated to 1650° F.±25° F., held at heat for 30 min.±3 min., cooled in air to room temperature, reheated to 1450° F.±25° F., held at heat for 15 min.±2 min., and cooled in air to room temperature.

(b) Product 0.1875 in. and over in nominal thickness shall be heated to 1650° F.±25° F., held at heat for 60 min.±5 min., cooled in air to room temperature, reheated to 1100° F.±25° F., held at heat for 8 hr.±0.25 hr., and cooled in air to room temperature.

The military standard MIL-H-81200B provides further recommendation for annealing and stabilizing other product forms as follows:

Bars and Forgings:

heat up to (beta transus—(25–50)° F.), hold for 1 to 2 hours, air cool, then heat up to 1100° F., hold for 8 hours, then air cool. Further, paragraph 6.3.4 of MIL-H-81200B recommends that wherever stabilized beta constituents within the micro-structure are desired, the stabilizing cycle can be applied following the solution heat treatment, and it is considered adequate that such cycle be carried out at (1050 to 1100)° F. for 8 hours (Note 2 of Table IV of MIL-H-81200B).

Other heat treat processing cycles, such as recrystallization anneal and stress relief are also known. The beta solution and-beta anneal heat treatments are similar to those in paragraphs (a) and (b), above, except that the solution or annealing temperatures are located at an unspecified point above the beta transus temperature. The MIL-H-81200B standard gives the beta transus temperature for Ti-6242 as 1820° F. Because silicon content, among other additives, tends to alter the beta transus temperature slightly, the best estimate of the beta transus temperature for the procured sheet of Ti-6242S was derived by interpolations of chemical variations versus beta transus data of S. R. Seagle, G. S. Hall, and H. B. Bomberger reported in their publication "High Temperature Properties of Ti-6Al-2Sn-4Zr-2Mo-0.09Si", Metals Engineering Quarterly, February 1975, pages 48–54. Based on the Seagle et al. procedure, the beta transus temperature for the alloy tested was found to be 1835° F. This temperature was used in defining the inventive heat treatments described later in the text.

Against this background of Standards and Standard-developed heat treatments, which have evolved over a period of time, the inventor has introduced several changes or deviations from the Standard procedures, and thus arrived at a crucially important discovery—the simultaneous enhancement of a multiplicity of mechanical and fracture properties.

The major departures from the Standard procedures as described above were:

(1) changes in the solution temperature and time at such a temperature;

(2) changes in cooling rates and media;

(3) elimination or avoidance of stabilizing anneals at temperatures above 1100° F.;

(4) use of a diffusion-kinetics-based theoretical model for more flexible aging regimes of equivalent thermal exposure effects at different time-temperature combinations; and (5) preferred environmental protection conditions.

The initial selections of heat treat processing parameters were verified via an extensive mechanical test program with a two-fold objective:

(1) to demonstrate unambiguously that the inventor-rationalized special process selection will deliver the anticipated simultaneous improvements in mechanical properties at cryogenic, ambient, and elevated temperatures; and (2) to provide a rigorous qualitative characterization of the relationships of such processing changes to observed patterns of microstructure and properties in sufficient detail that can reasonably validate the extension of the inventor-claimed special processing to a broader variety of alpha-beta alloys other than the demonstrator alloy Ti-6242S.

SOLUTION TEMPERATURE

The initial processing selection rationale of the inventor may be summarized as follows:

Upon cooling sheet stock of Ti-6242S alloy from a temperature point on the phase diagram within the subtransus region [alpha+beta] (see FIG. 2), the volume fractions of both coexisting phases vary with solution temperature. Such variations in volume fractions of phases are more pronounced as the solution temperature gets closer to the beta transus line separating $\alpha+\beta$ and $\beta$ regions in the phase diagram of FIG. 2. This in turn will vary the proportions and morphology of the transformed beta (i.e., lamellar $\alpha+\beta$ versus equiaxed primary $\alpha$ phase proportions in the microstructure.

The outcome of such adjustments in the solution temperature is often reflected in dramatic changes in certain properties of the alloy, particularly the fracture toughness, creep resistance, and fatigue properties. The inventor's technical approach utilized the proximity of the solution to transus temperature to optimize the microstructure and properties.

COOLING RATES

On the other hand, under certain circumstances, cooling rates from the solution temperature may also be significant. As shown in FIG. 3, the nature of the transformation-temperature-time "TTT" and continuous cooling transformation "CCT" diagrams for Ti-6242S are such that changes within a certain range of cooling rates are capable of inducing noticeable effects beginning with cooling rates on the order of still air cooling or faster cooling (e.g., circulated or convective gas cooling), which is greater than or equal to 10° F. per second (or equivalently 600° F. per minute). Such differences in cooling rates, if large enough and within the sensitive range, may induce some changes in the amount of retained beta and the degree of refinement of the transformed microstructure, namely $\alpha$ and $\beta$ plate widths. The delicate balance between these two features of the microstructure (i.e., retained beta phase proportions versus alpha plate width) may affect creep resistance. The associated primary and secondary creep rate dependencies have been quantified earlier by Cho et al. ("Creep Behavior of Near Alpha Titanium Alloys", Technical Report No. SR-88-112, Department of Materials Science and Engineering, The University of Michigan, Ann Arbor, Mich., January 1988) and Bania and Hall ("Creep Studies of Ti 6242-Si Alloy", in Deutsche Cesellschaft for Metallkunde, Adenauerallee 21, fifth International Conference on Titanium, Munich, Germany 1984).

Additionally, it has been suggested that cooling rates in the range of 700° F. to 1200° F. per minute are optimal for creep and low-cycle fatigue of $\alpha$-$\beta$ Ti-6242S. It will be shown below that cooling rates substantially lower than those previously suggested (see above) are optimum, not only for creep, but also for a host of other properties, including tensile, impact, low cycle fatigue, hydrogen embrittlement, fracture toughness and thermal stability.

The four remaining and equally important features of the heat treat cycle are (1) selection of the aging temperature range, (2) the soaking or "hold" time at the solution temperature, (3) the soaking or "hold" time at the aging temperature, and (4) the furnace environment.

AGING TEMPERATURE

The choice of the aging temperature range will influence the precipitation reaction kinetics, precipitate chemistry, morphology, and size distributions, all of which are strongly related to alloy strength and fracture toughness.

The optimization goal of the present inventor was to avoid deleterious silicide formations which would reduce both fracture toughness and strength should they precipitate preferentially into the grain boundaries.

Insufficient soak times at the solution temperature tend to reduce the amount of silicide precipitates going back into solution, and hence, their post-age volume fraction and number density per unit volume. This, then, influences the alloy's tensile ductility and cryogenic behavior including its ductile-to-brittle transition point. The time duration at aging temperature mainly affects precipitate coarseness, precipitate-matrix coherency strains and the relative efficiency of such precipitates as strengtheners (i.e., particle shearing and strain localization as opposed to dislocation by-pass mechanisms and diffuse strain distributions). Through the operation of these mechanisms, the aging time duration affects the alloy strength, its workhardening behavior, microstructural stability, and to some extent, fracture toughness.

The coarsening of such precipitates may be dominated by the diffusion rate of a single species. Accordingly, the inventor has derived a diffusion-kinetics-based equation for enabling the heat treater to use equivalent aging time-temperature combinations. The usefulness of this diffusion-based model can be extended to provide a semi-quantitative analytical tool for predicting equivalent long-term thermal stability of a given alloy microstructure from short term tests.

HEAT TREAT ENVIRONMENT

The role of the furnace environment on alloy properties is also crucial. The inventor used a vacuum and/or a pure argon environment, which virtually eliminated oxygen and/or nitrogen-induced alpha-case embrittlement, as well as the probability of hydride plate precipitation along certain crystallographic habit planes, which in turn could be a service-stress-assisted hydrogen embrittlement process.

Thus for high service performance, the inventor's processing selection rationale opts for minimal residual hydrogen content.

The processing-microstructure-property rationale described above has guided the inventor in his departures from the standard heat treatment procedures of MIL-H-81200B, as well as the AMS 4919B specification. These departures will be described quantitatively in the text that follows later.

With these departures from the standard procedures, the inventor was able to achieve improvements previously thought unattainable in the material property behavior titanium. Of all titanium alloys available, the inventor has selected the alloy Ti-6242S (the "demonstrator" alloy) for testing and comparison with the properties of other known alloys/heat treating processes.

The nature of the developed processing-microstructure-property relationships (detailed below) is such that the inventive method can be applied to other similar alpha-beta titanium alloys without significant adjustments. In order to better define the titanium alloy chemistries to which the inventive method is considered applicable, a tentative range of aluminum and molybdenum equivalents will be specified, thus identifying the approximate domain of the invention's applicability to alpha-beta titanium alloys.

Seven Basic Considerations Comprise the Optimizing Final Heat Treat Processing (HT2) Development With the earlier mentioned critical considerations of selection rationale in mind, numerous crucial departures from the Standards heat treatment procedures were introduced and the effect of such deviations from the Standards post-rolling heat treatment procedures were demonstrated for Ti-6242S sheet metal having the dimensions 0.063×36×96 in., procured per AMS4919B in the duplex annealed condition.

The following four departures from the standard procedures for alpha-beta titanium alloy heat treat per MIL-H-81200 were selected by the inventor, the sum of which constitutes a major thrust of the "HT2" heat treat process disclosed (below) and claimed in this application:

(1) The subtransus solution treatment temperature

This critical temperature was increased above the standard values to levels much closer to the beta transus line "$\beta_t$" (within 10° F. to 40° F. below $\beta_t$). For the specific vintage of Ti-6242S tested in the course of this invention, the recommended solution temperature was determined to be 1810° F., which is in contrast with the MIL-H-81200 Standard-recommended range for the same alloy of (1500 to 1675)° F.

(2) Hold time at the solution temperature

The hold time is also important in the optimization process of the present invention. Prolonged soaking at the solution temperature should have, as a goal, the achievement of a complete homogenization through diffusion of solute atoms and their thorough mixing into solution. Of particular interest were those solute atoms bound during prior processing into precipitates (silicides, carbides, carbonitrides, etc.) and/or brittle intermetallic compounds. The inventor's recommended hold time at the solution temperature for an average alpha-beta alloy is two to six hours with a preferred practice of two to three hours. For example, the longer hold times within the recommended range should be used in cases of alloys with a low tendency for excessive grain growth, containing slowly diffusing species with large atomic numbers, bound up into relatively large size precipitates and/or intermetallic compounds. In the case of the exemplary alloy, Ti-6242S, the inventor found that 2 hours of hold time at 1810° F. was sufficient to bring into solution all silicides previously generated during the duplex anneal heat treat processing. Furthermore, the inventor found that repeated successive applications of up to three solution heat treat cycles (without intervening age) totalling six hours of hold time at 1810° F. did not result in any significant increase in grain size or degradation of properties.

(3) Controlled cooling rates from the solution temperature

A reasonably flexible, yet limited, range of controlled cooling rates from the solution temperature was selected by the inventor (within 5° F. to 500° F. per minute, with a preferred mid-range of 60° F.±30° F. per minute). This range falls completely outside the MIL-H-81200 standard range based on "air cooling", the slowest rate beginning at about 10° F./second (or equivalently 600° F. per minute), with substantially higher cooling rates achieved with air circulation bordering on the quench rates of several thousand degrees per minute, depending on air circulation rate and inlet temperature versus stock thickness.

In contrast, the selected range of slower heat treatments appears to provide the flexibility of processing within the nearly isothermal transformation temperature range for more stable microstructures, while at the same time adds the controlled cooling feature for better product property reproducibility.

The cooling rates recommended for a broad range of applications of the inventor-developed optimization process are, however, significant to the extent described below (refer to FIG. 3):

a) The rates are slow enough to avoid the formation of acicular martensitic microstructure.

b) The rates are fast enough to avoid precipitation of silicides over the critical range of temperatures (about 1150° F. to 1550° F.).

With these considerations in mind, the inventor thus selected the overall cooling rate range for the whole cycle between (5° F. and 500° F.) per minute, with a preferred range of (60±30)° F. per minute from the solution temperature down to the aging temperature. This process may be followed by turning of the furnace heating power off, and continuing either to cool down at the natural furnace cooling rates in vacuum from the aging temperature down to about 350° F., or to directly age as described below, followed by cooling from the aging temperature at same rates specified herein.

(4) Selection of the aging (or stabilizing) temperature

Selection of the aging temperature was initially set at 1100° F. Subsequent microscopic evidence revealed that this should be the upper limit in order to prevent against the precipitation of detrimental silicides. On the other hand, the inventor's thermal stability analysis provided room for the use of slightly lower aging temperatures (e.g. 1050° F. and 1000° F.), but substantially longer times would be required (about 24 hours and 140 hours, respectively) which would be kinetically equivalent to 8 hours at 1100° F. The preferred practice is either 1100° F. for 8 to 12 hrs., or 1050° F. for 12 to 18 hrs.

(5) A semi-quantitative procedure for establishing required hold times during the aging cycles This model was also developed by the inventor. As noted above, the aging heat treatment cycle may either follow directly by initiating in the aging soak during cool down from solution temperature, or be carried out as an entirely separate cycle from ambient conditions including reheat, "soak" or "hold" time at the aging temperature, then cool down again to ambient conditions. In either case, the preferred hold time at aging temperature is 8 to 12 hours at 1100° F. for the exemplary alloy Ti-6242S. According to the inventor's method, other allowable time-temperature combinations include longer times at slightly lower aging temperatures with such combinations calculated such as to provide for kinetically equivalent aging effects. For example, in the case of the demonstrator alloy, the other equivalent time-temperature combination examples are as follows:

| | |
|---|---|
| @ 1050° F. | 12 to 18 hrs. |
| @ 1025° F. | 64 to 96 hrs. |
| @ 1000° F. | 140 to 210 hrs., etc. |

These hold time values are calculated using an equation derived by the inventor based on a test-validated, diffusion-kinetics theoretical model for quantification of thermal stability and equivalent aging effects in titanium alloys. Using a temperature of 1100° F. as a reference aging condition the inventor's equation states that:

$$t_T=(t_{1100°F.})EXP(Q[T^{-1}-\{([1100-32]\times 5/9)+273\}^{-1}]/R) \quad (1)$$

where $t_T$=aging hold time required at temperature T°K., $t_{1100°\ F.}$=aging hold time required at 1100° F., Q=the activation energy for diffusion of the aging precipitate growth controlling species, R=the standard gas constant (1.987 kcal/mole degree °K.)

Equation (1), which enables selection of the preferred age-time-temperature combination, was derived with the following considerations in mind:

(a) The aging temperature must be low enough to preclude the formation of incoherent precipitates and/or any other brittle intermetallic compounds, which may result in mechanical property degradation (e.g. titanium suicides in case of Ti-6242S). Based on electron microscopy data (to be reported later in this Section), this temperature is on the order to 1100° F.

(b) The aging temperature should be high enough so as to effect, within a reasonable time, the precipitation of ordered coherent precipitate alpha-2 within the primary alpha phase as its major strengthening constituent, while the duration of such a stabilizing age should be equivalent to 8 to 12 hours at 1100° F. as calculated by Equation (1). For practical considerations, the aging temperature range for most alpha-beta titanium alloys should be limited to the range of 1000° F. to 1100° F., with a preferred inner range set between 1050° F. and 1100° F.

Derivation of Equation 1 as a Model for Equivalent Thermal Aging Effects:

Thermal aging effects are often associated with (a) diffusion-controlled metallurgical processes, which may or may not result in precipitation of certain particles by a nucleation-and-growth mechanism, (b) partial or total recovery of deformed states (annealing out of dislocations, or restructuring of boundaries and interfaces, cell walls, etc.), and (c) decomposition of certain phases into others, for example transformation of certain martensites such as α' or α" into α+β or solute-rich ω into solute-lean ω plus β. It is clear that in all cases of aging (and averaging) diffusion of atoms and/or vacancies within the lattice plays an important and sometimes even dominant role.

Along with the metallurgical effects taking place within the alloy microstructure there are associated mechanical property changes observable at the macroscopic level over a certain period of time, which could be either short or very long and may be either beneficial (such as strengthening, toughening, etc.) or detrimental (e.g. embrittlement, loss of fatigue resistance, etc.). Material researchers and producers alike are often faced with the challenge of determining the extent of aging. Such a determination is often made a posteriori from hardness measurements, or destructively through fracture toughness testing. The former method lacks in rigor, while the latter is costly and time consuming. Furthermore, the choice of aging temperature is often made without a clear rationale, whereby a whole range of such temperatures could render identical results but with a different exposure time at the aging temperature. This model provides a method for rigorous quantification of such aging temperature-hold time combination. The basis for the existence of such a model derives from the fact noted earlier, namely that common to all types of aging processes, diffusion kinetics controls both the beneficial as well as the detrimental processes involving precipitate nucleation and growth, solute diffusion and phase decomposition, as well as vacancy diffusion and dislocation climb, etc. As a quantitative measure of the extent of diffusion controlled aging process, one may use the position of an interface boundary, which could be directly proportional to the extent of precipitate growth.

Using Darken's analysis (See P. G. Shewmon, "Diffusion in Solids", McGraw-Hill Book Company, New York, 1963, page 120), the velocity of an interface movement υ due to interdiffusion of two species 1 and 2 is given by:

$$\nu = (D_1 - D_2)\frac{\partial N_1}{\partial x} \quad (2)$$

where $N_1=C_1/C$ is the mole fraction of species 1 having $C_1$ moles per unit volume relative to C, the total number of both species 1 and 2 per unit volume, and $D_1$ and $D_2$ are their respective diffusion coefficients given by $$D_i = D_o \exp\left(\frac{-Q}{RT}\right) \quad (3)$$

where i=1,2

$D_o$ is a material constant,

Q is the activation energy for diffusion,

R is the standard gas constant, and

T is the absolute temperature.

From Equation (3) it follows that $$\frac{d\ln D_i}{d\left(\frac{1}{T}\right)} = \frac{-Q_i}{R} \text{ (with } i = 1, 2) \quad (4)$$

Also from Equation (2), the following obtains:

$$\ln\nu = \ln(D_1 - D_2) + \ln\left(\frac{\partial N_1}{\partial x}\right) \quad (5)$$

and $$\frac{d\ln\nu}{d\left(\frac{1}{T}\right)} = \frac{d\ln(D_1 - D_2)}{d\left(\frac{1}{T}\right)} + \frac{d\ln(\partial N_1/\partial x)}{d\left(\frac{1}{T}\right)} \quad (6)$$

The second term in Equation (6) is zero since it must be assumed here that $N_1$ is independent of the temperature used for aging.

Hence it follows that:

$$\frac{d\ln\nu}{d\left(\frac{1}{T}\right)} = \frac{d\ln D_1}{d\left(\frac{1}{T}\right)} + \frac{d\ln\left(1 - \frac{D_2}{D_1}\right)}{d\left(\frac{1}{T}\right)} \quad (7)$$

This relationship requires a knowledge of both $D_1$ and $D_2$ of the two interdiffusing species. But, if it is assumed, as is often the case, that the movement of the interface is largely dependent on the diffusion of the faster moving species, or equivalently if $D_2/D_1 \ll 1$, the second term is small (approaching zero), in which case the movement of the interaction layer boundary is dominated by the rate of transfer of say species 1. It follows that if the aging temperature is changed, the rate of interface motion (e.g. precipitate growth) will exhibit the same temperature dependence as the fastest moving species. Combining Equations (7) and (4), thus, gives:

$$\frac{d\ln v}{d\left(\frac{1}{T}\right)} \cong \frac{d\ln D_1}{d\left(\frac{1}{T}\right)} = \frac{-Q_1}{R} \tag{8}$$

Using the empirical findings of Smigelskas and Kirkendall (currently known as the "Kirkendall Effect") that the displacement of an interface relative to its initial position Xm is proportional to the square root of time or $$X_m = \alpha t^{\frac{1}{2}} \tag{9}$$

and hence $$v = \frac{dX_m}{dt} = \frac{X_m}{2t} \tag{10}$$

Substitution of Equation (10) into (8) yields $$\frac{d\ln(X_m/2t)}{d(1/T)} = \frac{-Q}{R} \tag{11}$$

Using finite differences gives $$\Delta\ln\frac{X_m}{2t}\Big|_{T_1}^{T_2} = \frac{-Q}{R}\,\Delta\left(\frac{1}{T}\right)\Big|_{T_1}^{T_2} \tag{12}$$

It then follows that $$[\ln X_m^{(T_2)} - \ln(2t)_{T_2}] - [\ln X_m^{(T_1)} - \ln(2t)_{T_1}] = \frac{-Q}{R}\left[\frac{1}{T_2} - \frac{1}{T_1}\right] \tag{13}$$

In this Equation, $Xm^{T_i}$ is the interface shift or phase growth at the aging temperature $T_i$, and $(t)_{Ti}$ is the aging soak time at $T_i$. In order for both aging time-temperature combinations to be equivalent it must be assumed that the phase growth in question in both cases is the same, or $$X_m^{(T_2)} = X_m^{(T_1)} \tag{14}$$

Substitution of Equation (14) into Equation (13) yields upon further simplification $$(t)_{T_1} = (t)_{T_2}\exp\left[\frac{Q}{R}\left(\frac{1}{T_1} - \frac{1}{T_2}\right)\right] \tag{15}$$

Equation (15) is-the generalized form of Equation (1), where the latter is a special application at an aging temperature of 1100° F. For purposes of an approximate calculation in case of close packed metals (such as alpha and alpha-beta titanium alloys), it is reasonable to assume an empirically established average value of Q=36 $T_m$ [Cal/°K.], where $T_m$ is the melting point of the solvent metal [15].

For a titanium-based alloy $T_m$=1668° C.=1941° K., and hence Q=69876 calories/mole. With these units,the value of the standard gas constant R is also given by R=1.987 calories/mole.Degree K.

Equation (15) provides a quantitative model for thermal aging effects regardless of whether these phenomena are due to artificial or natural aging. In this sense, it may also be used to predict the extent of material degradation with thermal aging. and in turn, could enable researchers to predict long-term degradation effects at a lower service exposure temperature from much shorter term thermal exposures at higher temperatures.

Figure 8:
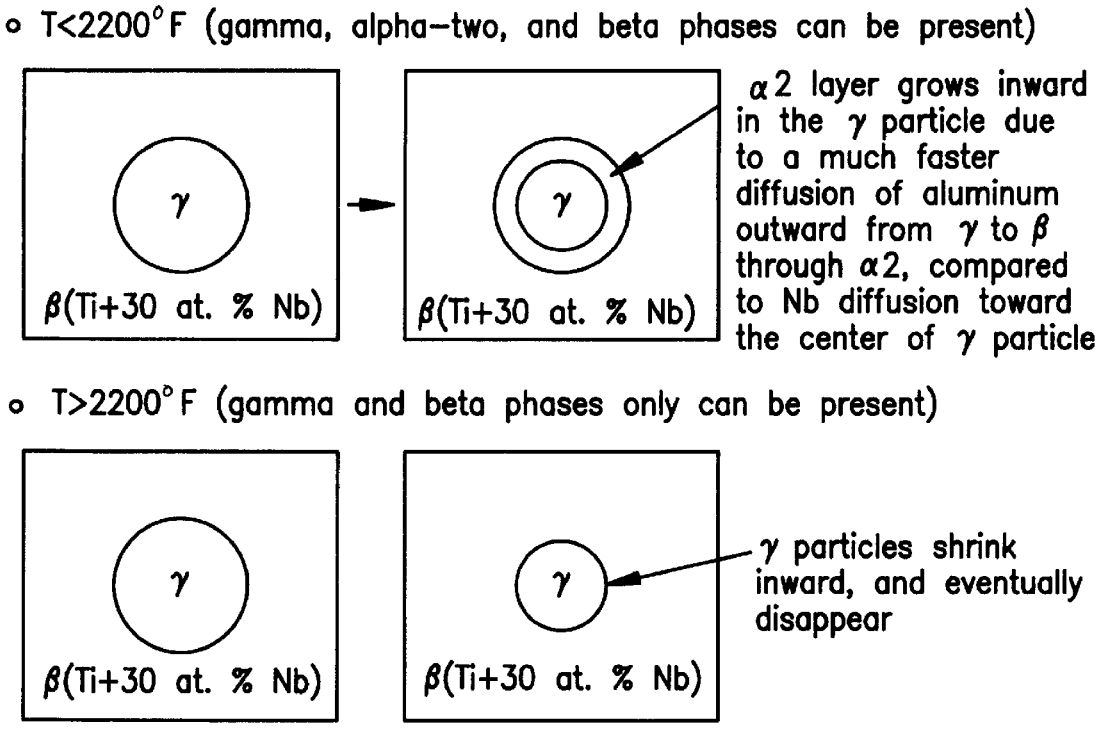
FIG. 8 is a schematic illustration of thermal degradation effects in a gamma phase-blended mix of (Ti-48Al-2.5Nb-0.3Ta) [at. %] mixed with 20 volume % (Ti-30Nb) [at. %] in which the kinetics of growth of alpha-2 phase of Ti at less than 2200° F. is predictable by Equation (15).

In order to verify the validity of the theoretically-derived model of Equation (15), it was applied to a study of thermal age degradation of a phase blended gamma-type titanium aluminide alloy. The alloy was prepared by extrusion of a gamma alloy powder having the composition Ti-48Al-2.5Nb-0.3Ta [at-%] within a matrix of 20 volume % of (Ti-30Nb) [at %] alloy. The latter has a beta phase microstructure surrounding the gamma particles as shown in FIGS. 4, 5, 6 and 7. The role of the beta matrix is to provide for enhanced fracture toughness of the relatively brittle gamma alloy. Degradation of the phase-blended alloy fracture toughness takes place, however, with prolonged thermal aging exposure at high temperatures or during certain high temperature fabrication process soak times. A layer of brittle intermetallic $Ti_3Al$ or $\alpha_2$ titanium forms at the interface between the beta and gamma phases as shown schematically in FIG. 8. This could result in premature fracture initiation or reduction in the fracture stress of the phase-blended alloy. Measurement of the extent of age degradation in this material system may, thus, be reduced to establishing the extent of growth of the interfacial $\alpha_2$ detrimental layer, as a function of soak time, and verifying whether the kinetics of such a growth process are consistent with the predictions of Equation (15).

Three samples of the above-mentioned as-extruded phase-blended alloy were exposed to 1950° F. temperature: one for 10 minutes, another for one hour, and a third for four hours. In each case, the extent of $\alpha_2$ layer growth (or thickness) was measured and averaged in the vicinity of 30 gamma particles. In order to further accentuate the thermal degradation process, other exposures at still higher temperatures (Table 2 below) were also characterized and the observed phenomena are summarized in FIG. 8, while the $\alpha_2$ phase growth measurements are plotted in FIG. 9 as a function of thermal aging soak time.

TABLE 2

Thermal Degradation Exposures of an Extruded Phase-Blended Gamma Titanium Aluminide Alloy Simulating High-Temperature Processing Soak Times

| Exposure Time-at-Temperature Condition | 1950° F. | 2150° F. | 2350° F. |
|---|---|---|---|
| 10 Minutes | X | X | X |
| 1 Hour | X | X | |
| 4 Hours | X | | |

Figure 9:
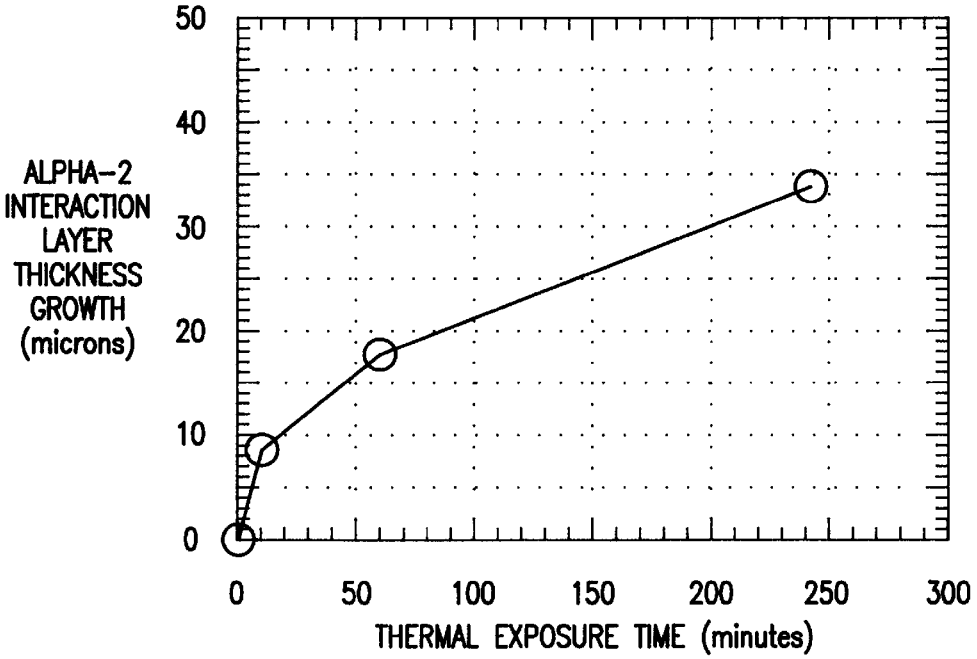
FIG. 9 is a graph showing the dependence of interfacial alpha-2 phase growth on exposure time at 1950° F. in a phase blended gamma alloy (Ti-48Al-2.5Nb-0.3Ta) [at. %] mixed with 20 volume % (Ti—Nb) [at. %] beta phase (matrix).

From the data shown in FIG. 9, it appears that the growth of the detrimental $\alpha_2$ interface layer is parabolic in time, i.e. the interface displacement $X_m$ is related to exposure time at the aging temperature $T_i$ as $$(X_m)_{Ti} \text{ is proportional to } \sqrt{t_{Ti}} \tag{16}$$

This parabolic growth behavior can be predicted using the derived thermal aging Equation (15), as follows:

Equation (15) can be rewritten as:

$$t_{T_1}/t_{T_2} = \exp(-Q/RT_2)/\exp\left(\frac{-Q}{RT_1}\right) \tag{17}$$

or $$t_{T_1}/t_{T_2} = D_o\exp\left(\frac{-Q}{RT_2}\right)/D_o\exp\left(\frac{-Q}{RT_1}\right)$$

Using Equation (3), it follows that:

$$t_{T_1}/t_{T_2} = D_{T_2}/D_{T_1} \tag{18}$$

Therefore, $$\sqrt{t_{T_1}D_{T_1}} = \sqrt{t_{T_2}D_{T_2}} \tag{19}$$

If two time-temperature combinations are used, the imposition of equivalent thermal aging effects means that the extent of $\alpha_2$ phase growth $(Xm)_i$ is the same at $(t_{T1}, T_1)$ and $(t_{T2}, T_2)$, so that $$(X_m)_{T_1}=(X_m)_{T_2} \tag{20}$$

Dividing Equation (20) by (19), the square root dependence relation sought earlier is obtained, namely that, $$(X_m)_{T_1}/\sqrt{t_{T_1}D_{T_1}} = (X_m)_{T_2}/\sqrt{t_{T_2}D_{T_2}} \tag{21}$$

or equivalently $$(X_m)_{T_i}/\sqrt{t_{T_i}D_{T_2}} = \text{Constant} \tag{22}$$

from which it follows that, $$(X_m)_{T_i} \text{ is proportional to } \sqrt{t_{T_i}} \tag{23}$$

which predicts the experimentally observed parabolic growth behavior of the detrimental $\alpha_2$ interface layer (FIG. 9) as derived from Equation (15). From the foregoing analysis it follows that the derived predictive model of Equation (15) has a duel usage in connection with thermal aging effects:

(1) To predict the required exposure time-temperature combination that could result in equivalent aging effects.

(2) To extrapolate to long term exposures in service (at some lower temperature) from-test data established in samples exposed for much shorter times at higher temperatures then mechanically tested for property degradation due to aging effect equivalent to those predicted at the much longer service exposure.

(6) Environmental protection procedure

The inventor's process also includes the following environmental protection procedure. While cooling under controlled rate, as noted above, cooling is fully executed within a vacuum environment by first turning the furnace power off, and only if necessary, circulating pure argon (or other pure inert gas), in order to maintain the cooling rate within the preferred range over the temperature drop from [$\beta_t$ −25° F.)±15° F] to 1100° F. Cooling from 1100° F. to either ambient or approximately 350° F. is to be also achieved in vacuum with the furnace power off. Subsequently venting with either air or inert gas is acceptable,in order to shorten the total cycle duration, without the risk of any detrimental effects.

The overall objective of the environmental protection steps during this heat treat cycle development is to minimize or completely eliminate the potential of hydride platelet precipitation along certain crystallographic or habit planes within the final alloy microstructure, which may occur even in service by a stress-assisted mechanism given that the part contains excess residual hydrogen following completion of all processing.

(7) The optimized overall processing sequence(s) combines thermomechanical and heat treat processing procedures The above heat treat sequence is to be regarded as the final crucial step modifying all preceding thermomechanical processing of the alloy microstructure by rolling, such that the optimized overall processing sequence(s) combines the total thermomechanical/heat treat processing pathway(s).

Figure 10A:
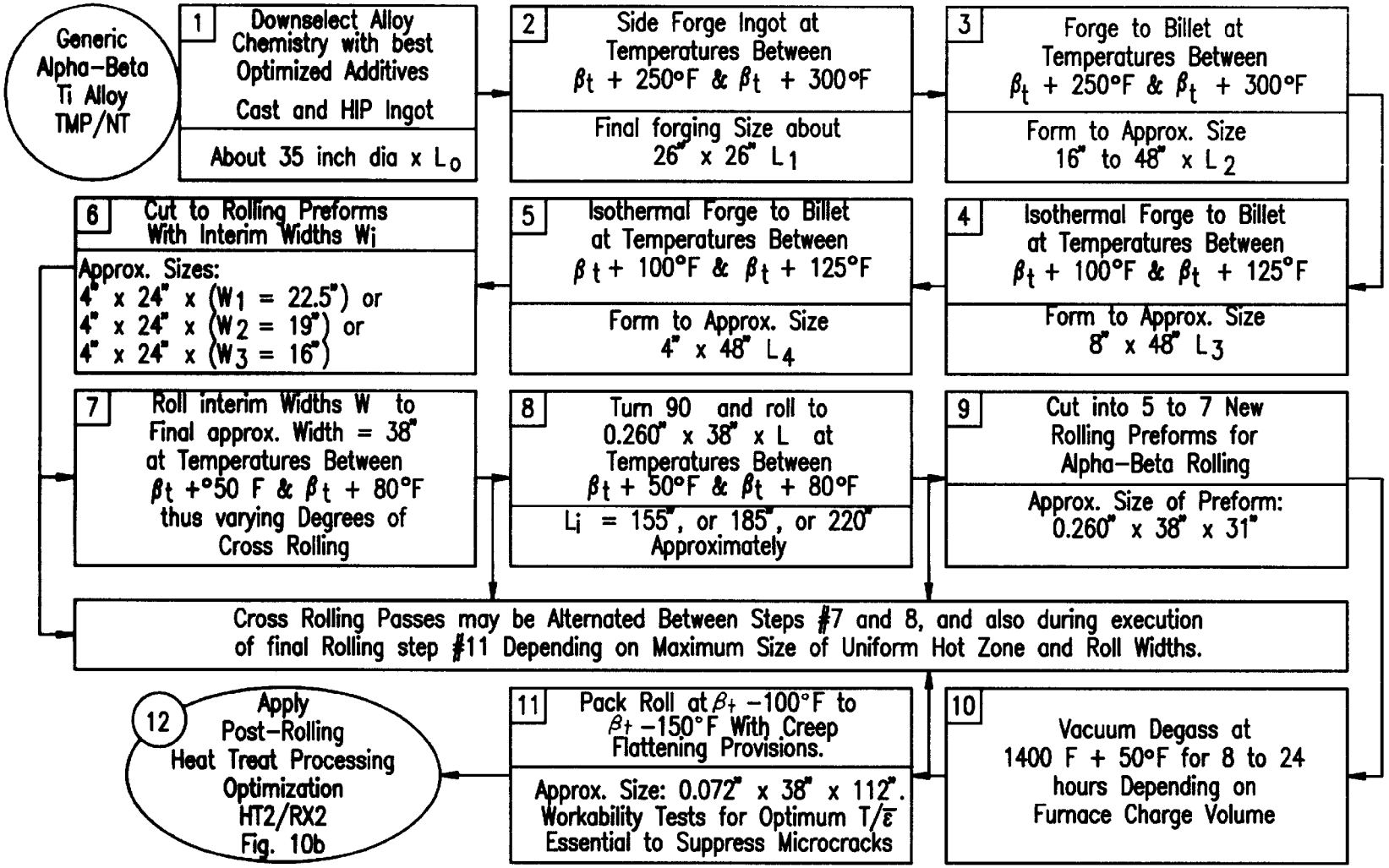
FIG. 10*a* is a schematic flow chart of the thermomechanical processing sequence of the present invention.
Figure 10B:
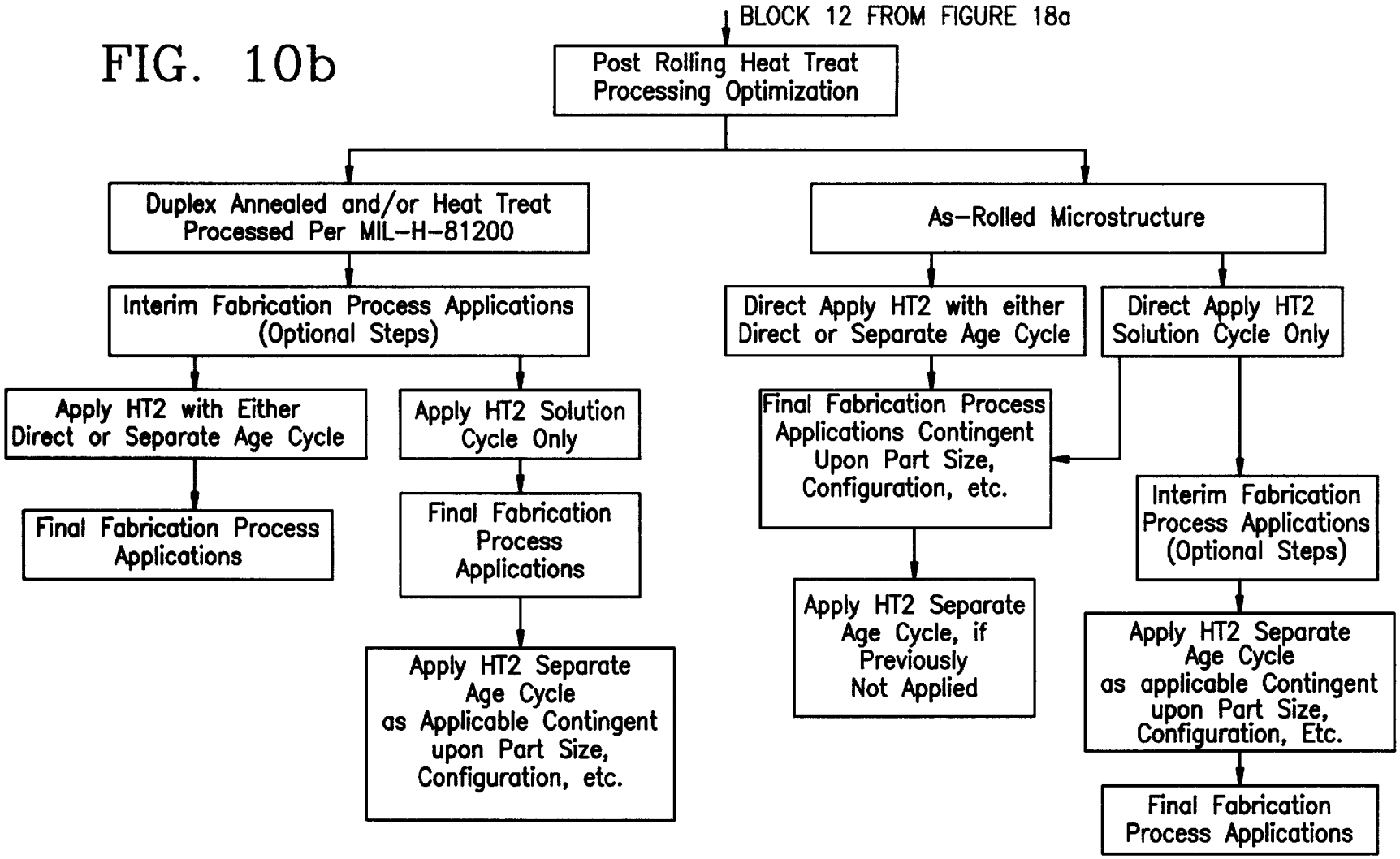
FIG. 10*b* is a schematic flow chart of the heat treat processing sequence of the present invention.

For Ti-6242S, this may or may not include the duplex annealing step, as illustrated schematically in FIG. 10. In other words, the final, crucial, heat treat processing sequence is recommended for use in optimizing either the as-rolled "virgin" microstructures or in modifying/improving microstructures which had been rolled and mill-heat treated, as well as microstructures thereof which may be further subjected to secondary fabrication processing steps. The improved modification will be characterized in detail below in a section relating to the "RX2" alloy (a designation used by the inventor to identify a second modification selected from among five modifications originally tested (RX1–RX5).

In summary, the heat treating process of the present invention (identified as "HT2") consists of a solution heat treat anneal in vacuum at a pressure on the order to $10^{-5}$ Torr or better, followed by aging (stabilizing heat treatment in vacuum, also at $10^{-5}$ Torr or better). The solution heat treat temperature for Ti-6242S was 1810° F. for two hours, or in more general terms ($\beta_t$ −10° F.) to ($\beta_t$ 40° F.), where $\beta_t$ is the beta transus temperature. For other $\alpha+\beta$ titanium alloys; it is recommended that a more generic descriptor ($\beta$-$\theta$° F.)±(5 to 15)° F. be used. This latter expression makes allowance for the normal capability limits of the average temperature controller. The value of $\theta$ F. should be such that it results in a 50 volume percent of the equiaxed alpha phase (coexisting with the lamellar coarse Wiedmansttaten phase). The latter phase takes the form of transformed $\alpha+\beta$ platelets or laths, which in turn have either a singular or duplex degree of refinement. This singular or duplex nature combined with the coexisting equiaxed primary alpha phase comprises either a duplex or triplex microstructures, respectively. The optimum microstructure is one which has approximately 50% equiaxed primary alpha strengthened with $\alpha_2$ precipitates and coexisting with 50% lamellar $\alpha+\beta$ phase. Cooling from the solution temperature is under controlled conditions in a vacuum of $10^{-5}$ Torr or better, controlled with periodic inert gas bleed-in (e.g. pure argon) for combined convective-plus-radiative control of cooling rate.

DESCRIPTION OF THE OVERALL OPTIMIZED THERMOMECHANICAL/HEAT TREAT PROCESSING PATHWAYS FOR $\alpha+\beta$ TITANIUM ALLOYS With the establishment of these HT2 parameters, the optimized thermomechanical/heat treat processing sequence then consists of a set of processing steps, following several pathways conceived by the inventor for improving the microstructures and properties of rolled alpha-beta titanium alloys as shown schematically in the examples of FIG. 10 using the selected concept-demonstrator alloy Ti-6242S.

With these microstructure optimization steps implemented, the basic phases coexisting in the product microstructure are $\alpha+\alpha_2+\beta$ (without silicides and/or brittle inter-metallics). Based on the results of a multitude of mechanical property tests conducted and discussed below, the newly-discovered unique category of microstructure and associated strengthening mechanisms was found to be highly beneficial to the alpha-beta titanium alloy mechanical behavior and overall mechanical property balance. The microstructure of an optimized typical alpha-beta titanium alloy consisting of $\alpha+\alpha_2+\beta$ only (without silicides and/or brittle intermetallics has never been listed as one of the standard "microstructural categories" of titanium alloys, where each is tied in with a specific combination of strengthening mechanisms (see E. W. Collings, "The Physical Metallurgy of Titanium Alloys, American Society for Metals, Metals Park, Ohio 44073, page 68; and M. Hoch, N. C. Birla, S. A. Cole, and H. L. Gegel, "The Development of Heat Resistant Titanium Alloys", Technical Report AFML-TR-73-297, Air Force Materials Laboratory, December 1973). These specifically-identified microstructure/strengthening-mechanism combinations have been well known to various investigators over the last two decades. In comparison with the Hoch et al. standard classification of microstructural categories, the inventive microstructure constitutes a "missing link" in the sequential chain of the processing-induced evolution of standard classes of titanium alloy microstructural categories.

More specifically Hoch et al. (see above) identified the following eight (8) classes of titanium alloy microstructural combinations:

Class 1: Simple multicomponent $\alpha$-phase solid solutions

Class 2: Simple $\alpha+\alpha_2$ two-phase systems

Class 3: Simple $\alpha+\alpha_2+\beta$+silicide systems

Class 4: Complex $\alpha+\alpha_2+\beta$+intermetallic-compound systems

Class 5: $\alpha_2$ systems

Class 6: $\alpha_2$+intermetallic-compound systems

Class 7: $\beta$ systems (stable at all temperatures)

Class 8: $\beta$+intermetallic-compound systems

The inventor's discovery of an important class of titanium alloy microstructures fits as a "missing link" among the earlier established classes of microstructures and associated strengthening mechanisms (fitting precisely between "Classes" No. 2 and 3 above), thereby creating nine (9) instead of eight (8) possible classes as follows:

Class 1: Simple multicomponent $\alpha$-phase solid solutions,

Class 2: Simple $\alpha+\alpha_2$ two-phase systems,

Class 3: "the inventor's newly-discovered missing link" Simple $\alpha+\alpha_2+\beta$ three-phase systems (the present invention)

Class 4: Simple $\alpha+\alpha_2+\beta$+silicide systems,

Class 5: Complex $\alpha+\alpha_2+\beta$+intermetallic-compounds,

Class 6: $\alpha_2$ systems,

Class 7: $\alpha_2$+intermetallic-compound systems,

Class 8: $\beta$ systems (stable at all temperatures),

Class 9: $\beta$+intermetallic-compound systems,

It will be shown below in a later discussion that this new class of titanium alloy microstructures exhibits the best possible property balance when compared with other classes previously obtained within the same alloy system, for example simple $\alpha+\alpha_2+\beta$+silicide category in the new "Class 4".

The inventor's thermomechanical/heat treat processing sequences yielding alpha-beta titanium alloy product forms conforming to $\alpha+\alpha_2+\beta$ (only) constitutes an important achievement yielding a highly significant and unique category of titanium alloy microstructures designed for high performance structures requiring a combination of high strength, ductility, high modulus, high fracture toughness, creep resistance as well as both hydrogen and cryogenic embrittlement resistances. The inventive thermomechanical heat treatment process(es) represent(s) an important advancement in the field of metallurgy. Notwithstanding the fact that these deviate from the standard heat treatment process(es) per MIL-H-81200 B, they result not only in simultaneous dramatic improvements of a broad range of properties of titanium alloys, but also substantially exceed the titanium producing supplier's own expectations for maximum strength-toughness combinations and high temperature performance (see the comparison, for example, of Ti-6242S with Ti 1100).

Test results and analyses will be provided below which lead to the above conclusions. However, first it would be instructive to elaborate and document the special features of the unique and new microstructures obtained with RX2 processing optimization in comparison with those of other less viable product pathways including final heat treatments.

The titanium material subject to the above-mentioned optimization processing (i.e., Ti-6242S) was prepared in several heat treatment conditions ("HTi", where i=1–5): (a) as-received $\alpha/\beta$-rolled sheet (duplex annealed or "HT1") beta-annealed for creep property enhancement ("HT3"), (b) subtransus annealed for balance between room and elevated temperature properties ("HT2"), (c) a special stabilizing heat treatment at 1450° F. ("HT4"), and solution and age heat treatment per MIL-H-81200 Standard ("HT5"). All heat treatments were conducted in vacuum at a pressure less than $10^{-5}$ torr and a controlled cooling rate of about 1° F./sec for optimum properties.

The objective of the heat treatment development was to evaluate heat treatment conditions other than the standard duplex annealed condition ("HT1") or the MIL-H-81200 ("HT5") and ones that could provide a better balance of room, cryogenic, and elevated temperature strength and ductility properties, in addition to possible improvement of environmental resistance such as casual hydrogen compatibility creep and low cycle fatigue.

For this investigation, a single sheet of material measuring 0.063 in.×36 in.×95 in. was procured from a rolling mill producer in the duplex annealed condition per AMS 4919B specification (also referred to as "HT1"). The chemical analysis of this sheet is given in Table 3 below, where the first row identifies the element of the composition, and the second row identifies the weight percent of that element in the composition.

TABLE 3

Chemical Composition of Ti-624S Sheet

| C | N | Fe | Al | Zr | Sn | Si | Mo | O | H (ppm) | Y (ppm) |
|---|---|---|---|---|---|---|---|---|---|---|
| 0.01 | 0.010 | 0.05 | 5.9 | 4.0 | 1.9 | 0.091 | 2.0 | 0.088 | 59 | <50 |

Table 4 below presents the room and elevated temperature properties obtained initially from the material supplier.

TABLE 4

9/24 Tensile Properties of Ti-6242S Sheet

| Test Direction | Yield Strength (ksl) | Ultimate Strength (ksl) | Plastic Elongation (%) |
|---|---|---|---|
| Room Temperature | | | |
| Longitudinal | 145.9 | 145.4 | 10 |
| Longitudinal | 146.5 | 150.2 | 12 |
| Transverse | 138.2 | 143.6 | 10 |
| Transverse | 140.9 | 146.2 | 12.5 |
| 900° F. | | | |
| Longitudinal | 88.9 | 104.3 | 14 |
| Transverse | 80.8 | 95.9 | 15 |

Prior processing history, to which the procured material was ordered, is as follows: An initial 36-in. diameter ingot of Ti-6242S was homogenized at 2100° F., and broken down through a series of steps at 2100° F., 1950° F., and 1900° F. The ingot was then turned 90 deg., rolled at 1900° F. to 0.250 in. thickness, vacuum degassed at 1450° F., and then final pack rolled at 1700° F. to near finish size (0.072 in×38.25×111 in.).

Figure 11:
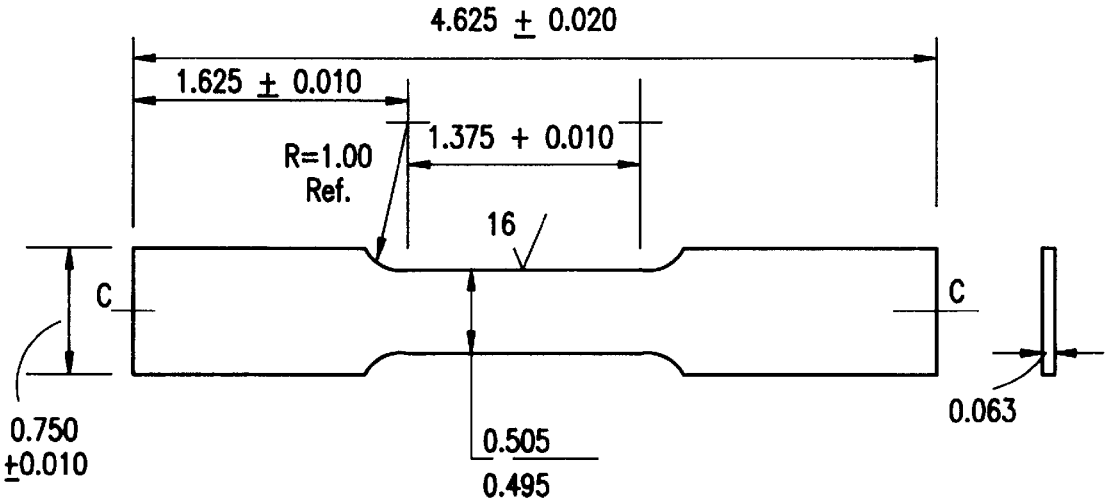
FIG. 11 is a view of a test specimen used for tensile, creep and fatigue testing in order to evaluate different heat treatment effects on mechanical properties, thermal stability, and environmental compatibility of the demonstrator alloy Ti-6242S.

Test specimens of both the longitudinal and transverse orientations were EDM cut and finish ground as shown in FIG. 11. The specimens were then grouped for different vacuum heat treat exposures. Some were kept in the duplex annealed condition for comparison of the newly developed conditions with a mill annealing treatment (HT1). The following list describes the five basic heat treatment conditions studied:

HT 1: As received, duplex annealed. 1650° F./30 min/air cool, plus 1450° F./15 min/air cool HT 2: As received, duplex annealed; subjected to 1810° F. (vacuum)/2 hr/control cool in ultra pure argon at 60° F./min to room temperature then 1100° F. (vacuum)/8 hr/cool in vacuum to room temperature.

HT 3: As received, duplex annealed, subjected to 1875° F. (vacuum)/2 hr/control cool in ultra pure argon at 60° F./min to room temperature, then 1100° F. (vacuum)/8 hr/cool in vacuum to room temperature.

HT 4: As received, duplex annealed, subjected to 1450° F. (vacuum)/4 hr/furnace cool to room temperature in vacuum.

HT 5: As received, duplex annealed, subject to MIL-H-81200B standard heat treatments (cooled in argon).

Based on specific chemistry of the received alloy (Table 3), it was initially determined that the transus temperature of this alloy is approximately 1835° F. [6]. With this in mind, the choice of solution temperature for HT2 was intended to be approximately 25° F.–30° F. below the beta transus temperature. The solution temperature for HT3 was aimed at testing the beta solution annealed and aged condition ($\beta_t$+35° F.). The extended stabilizing anneal at 1450° F. of HT4 was aimed at evaluating the effect of this step on alloy ductility and cryogenic properties. The fifth heat treat step was directed at verifying the advantages, if any, of the MIL-H-81200 Standard conditions over other conditions.

MATERIAL CHARACTERIZATION

Microstructural Characterization of Differently Heat Treated Ti-6242S Sheet Specimens Samples subjected to different heat treatments described earlier were examined with both the optical and transmission electron (TEM) microscopes to determine the extent of beta phase decomposition, ordering phenomena, dislocation substructure, and precipitates, if any (e.g., silicide formations).

Figure 5:
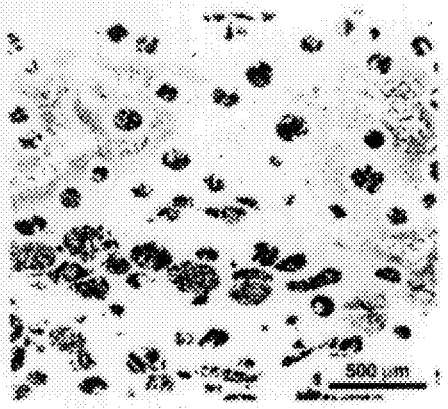
FIG. 5 shows the microstructure of thermally exposed phase blended gamma titanium aluminide Ti-48Al-2.5Nb-0.3Ta [at. %] mixed with 20 volume % [Ti-30Nb] at. % held at 1950° F. for 4 hours (magnification of 50 times).
Figure 6:
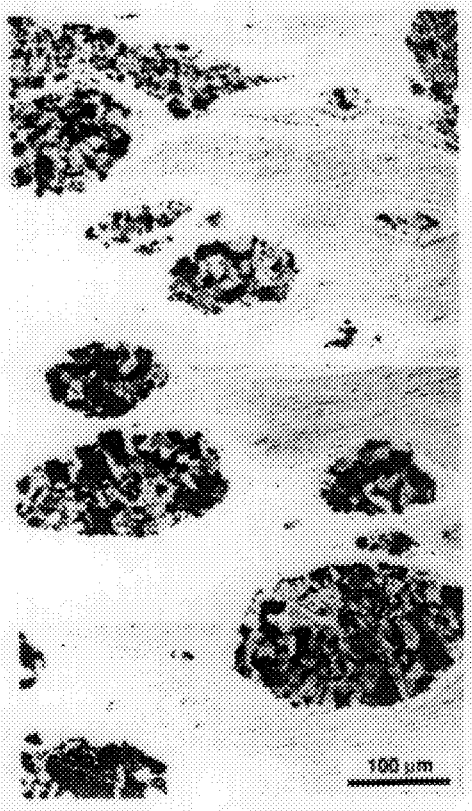
FIG. 6 is the microstructure shown in FIG. 4 at a magnification of 250 times.
Figure 7:
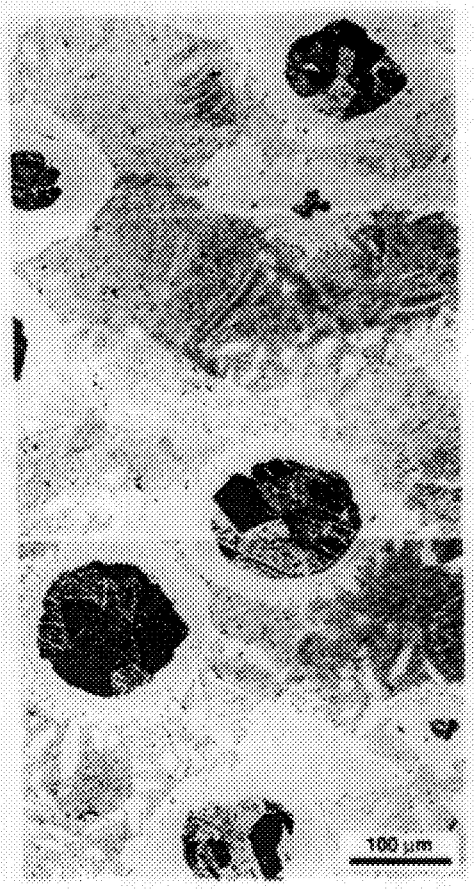
FIG. 7 is the microstructure shown in FIG. 5 at a magnification of 250 times.
Figure 15:
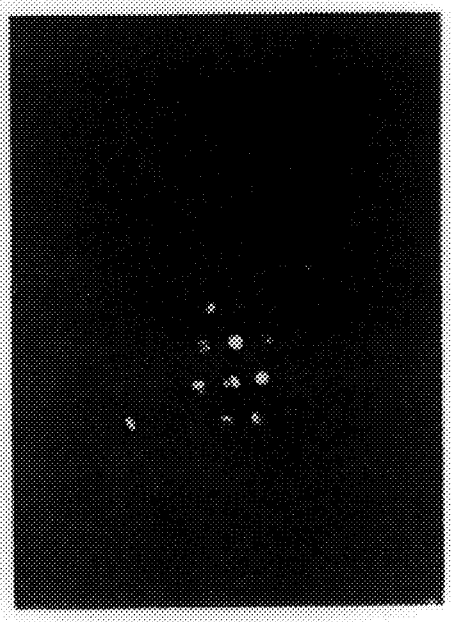
FIG. 15 is a diffraction pattern for primary alpha—alpha grain boundary silicides shown in FIG. 14 indicating non-stoichiometric lattice parameters relative to a $Ti_5Si_3$ or $(Ti,Zr)_5Si_3$ composition within the duplex annealed HT1 sample.
Figure 16:
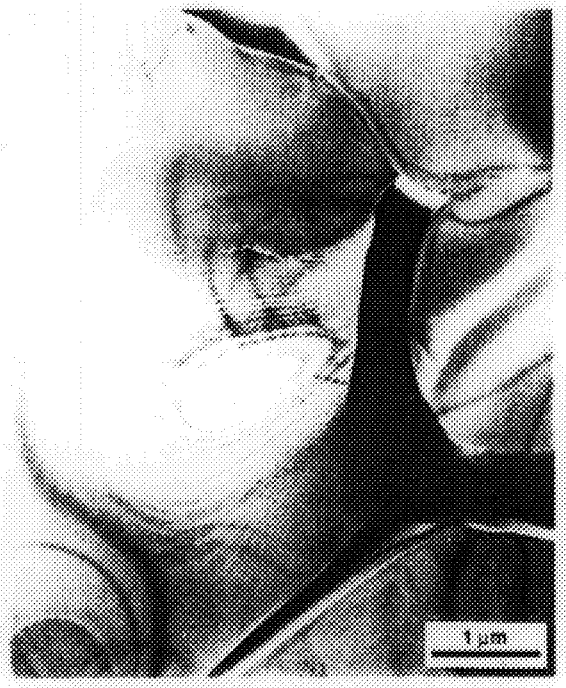
FIG. 16 is a dark-field TEM image of the primary alpha phase in an HT1-processed sample of Ti-6242S showing very little dislocation density in the alpha phase.
Figure 17:
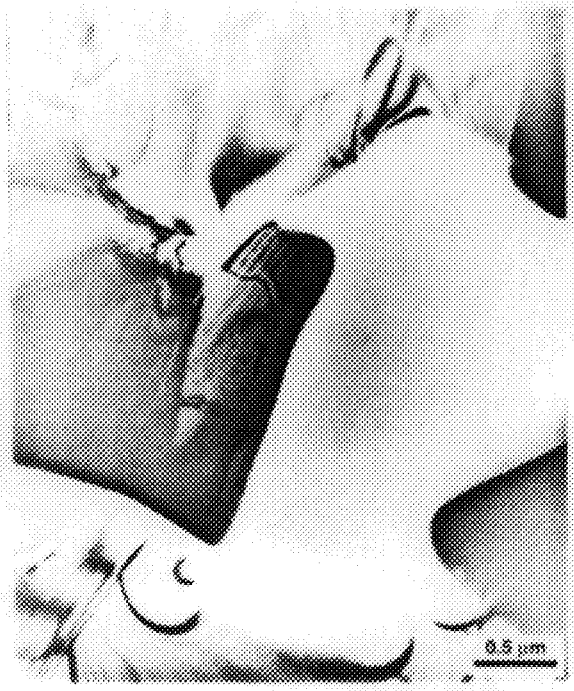
FIG. 17 is a dark-field TEM image showing beta phase (dark patch in the middle) with very low dislocation density in HT1-processed samples of Ti-6242S.
Figure 19:
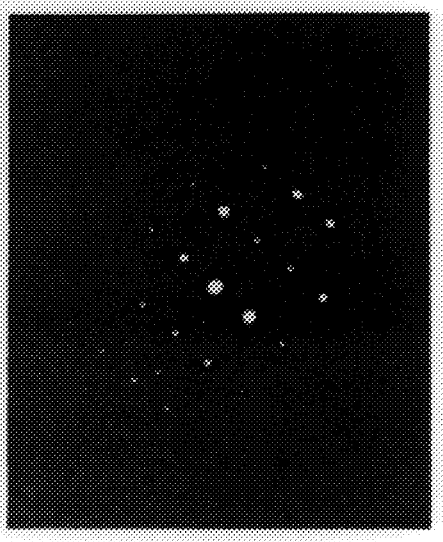
FIG. 19 is a $[110]_\beta$ diffraction pattern of HT1-processed (duplex annealed) Ti-6242S sample (beta phase).
Figure 18:
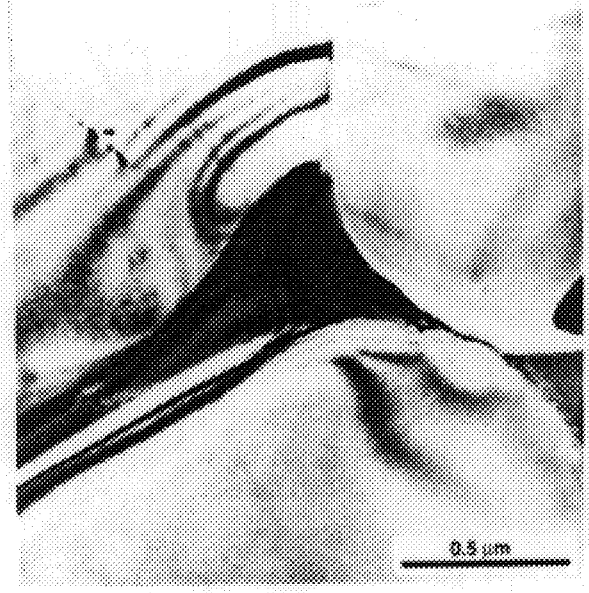
FIG. 18 is a TEM image of an HT1-processed (duplex annealed) sample of Ti-6242S showing a typical beta patch (dark area in the middle) with lack of decomposition (i.e., no $\alpha$ or $\omega$ phase).
Figure 20:
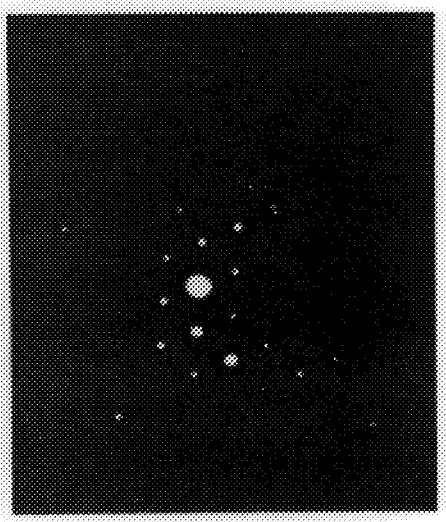
FIG. 20 is a $[1123]_\alpha$ diffraction pattern of an HT1-processed (duplex annealed) Ti-6242S sample primary alpha phase.

Duplex Annealed Microstructure (HT1) The duplex annealed microstructure in FIG. 5 (*a* and *b*) shows a fine, discontinuous beta phase in an equiaxed alpha-grain matrix. The TEM revealed that small silicide precipitates (FIG. 4, 0.1 to 0.2$\mu$) were present mainly at primary (alpha-alpha) boundaries. These precipitates have a hexagonal crystal structure, but the lattice parameters are significantly different from stoichiometric $Ti_5Si_3$ or $(Ti,Zr)_5Si_3$ (See FIG. 15). The alpha phase shows very few dislocations (FIG. 16), as does the beta phase (FIG. 17). There is no evidence of beta phase decomposition in this microstructure (FIG. 18) since only fundamental body-centered cubic reflections were obtained (FIG. 19) showing no evidence of either alpha or omega phase presence in the HT1 (duplex annealed) samples. Another most critical finding in this microstructure is that the primary alpha phase showed no evidence of $\alpha_2$ precipitates as evidenced by the diffraction pattern in FIG. 20.

Subtransus Annealed and Aged Microstructure (HT2)

Figure 21:
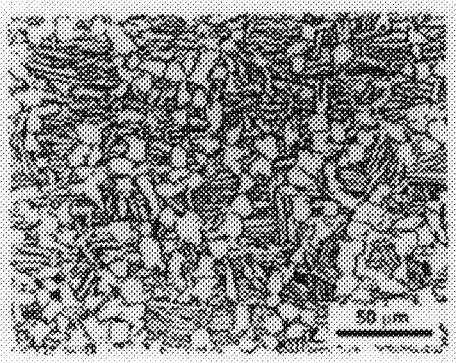
FIG. 21 is an optical photograph of an HT2-processed (subtransus annealed and aged) Ti-6242S sheet sample.
Figure 23:
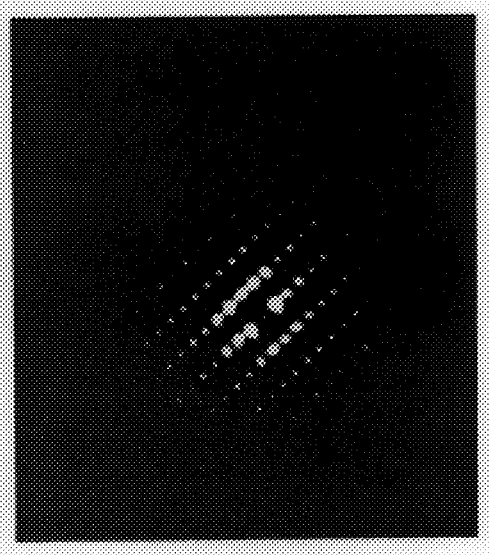
FIG. 23 is a $[1120]_\alpha$ diffraction pattern taken within the primary alpha phase of an HT2-processed (subtransus annealed and aged) Ti-6242S sheet sample showing a superlattice pattern giving evidence of $\alpha_2$ presence within the primary alpha phase.
Figure 22:
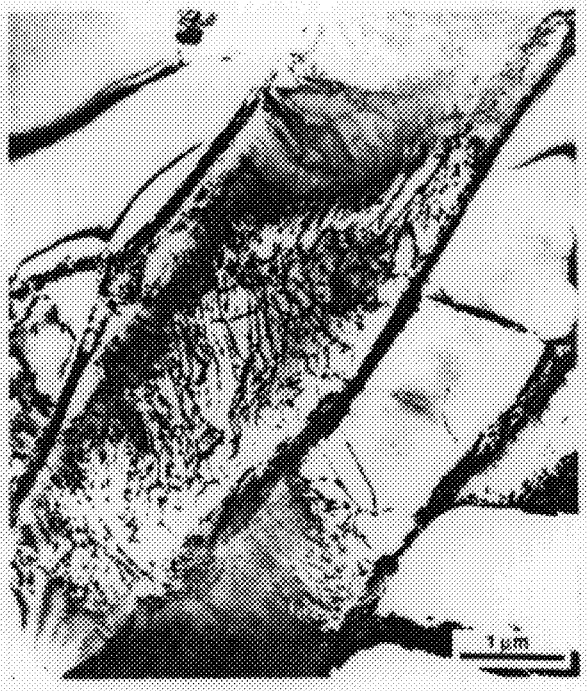
FIG. 22 is a TEM image of secondary alpha platelets in an HT2-processed (subtransus annealed and aged) Ti-6242S sheet sample showing moderate dislocation density taken as evidence of some coefficient of expansion mismatch.
Figure 24:
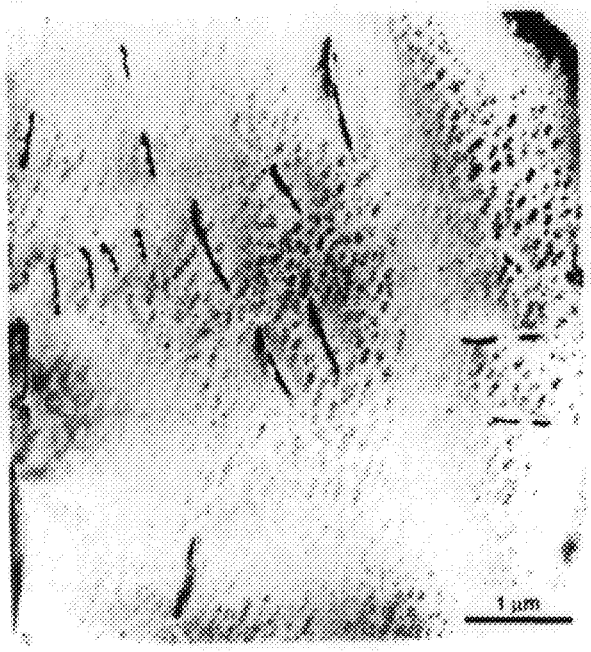
FIG. 24 is a TEM image of a primary alpha grain within an HT2-processed (subtransus annealed and aged) Ti-6242S sheet sample showing $\alpha_2$ (mottled background particles) and dislocation patterns within the alpha matrix.
Figure 25:
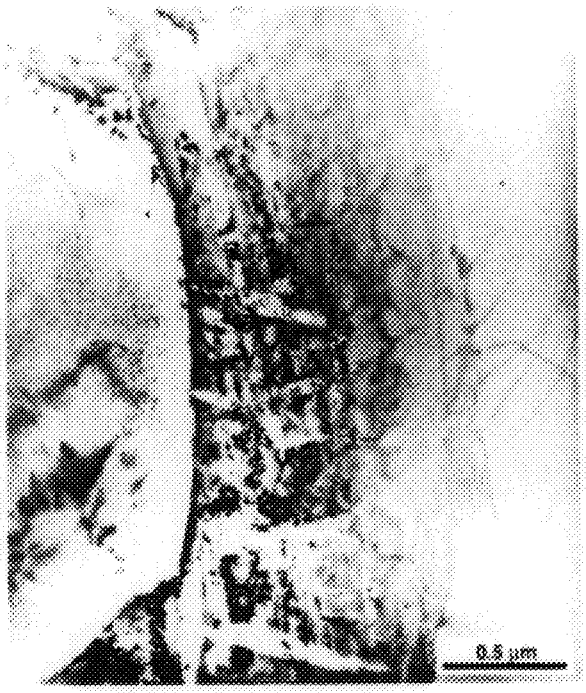
FIG. 25 is a TEM image of secondary alpha and beta within the decomposed prior beta grains (at solution temperature) subject to HT2 processing (subtransus anneal and age) of Ti-6242S sheet sample, evidencing a triplex microstructure.
Figure 26:
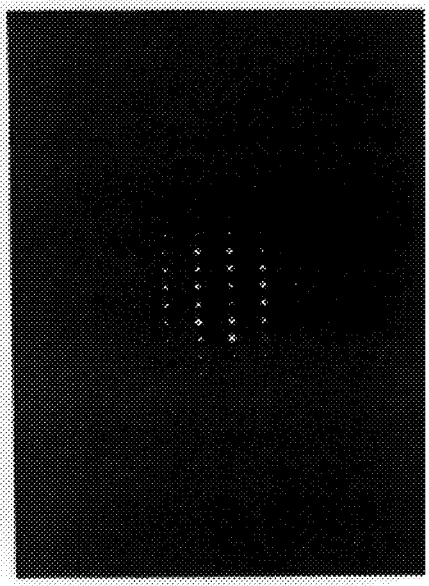
FIG. 26 is a $[1120]_\alpha$ diffraction pattern in the secondary alpha platelets in FIG. 25 showing no evidence of ordering to $alpha_2$ as distinguished from primary alpha structure as shown in FIGS. 23 and 24.

This sample (shown in FIG. 21) was solution treated at 1810° F. (just below the beta transus) followed by a low temperature stabilizing age treatment at 1100° F. Optical microscopy showed a duplex microstructure consisting of equiaxed primary alpha grains and elongated secondary alpha grains in a beta matrix. The secondary alpha structure (FIG. 22) was beta phase at the solution temperature, and formed as a result of its decomposition during furnace cooling. TEM revealed no apparent silicide particles in the microstructure. The primary alpha grains, which have few dislocations, exhibit faint superlattice diffraction reflections, indicating ordering to $\alpha_2$ (see FIGS. 23 and 24). The secondary alpha grains (see FIGS. 22 and 25), which contain numerous dislocations, showed no evidence of ordering (note FIG. 26). There is extensive alpha precipitation within the beta phase matrix (FIG. 25), most likely occurring during the 1100° F. age. As a result, there is a triplex distribution of alpha phase, namely large equiaxed primary grains, smaller secondary plates, and still smaller platelets within the remaining beta-phase matrix.

Beta Annealed and Aged Microstructure (HT3)

Figure 27:
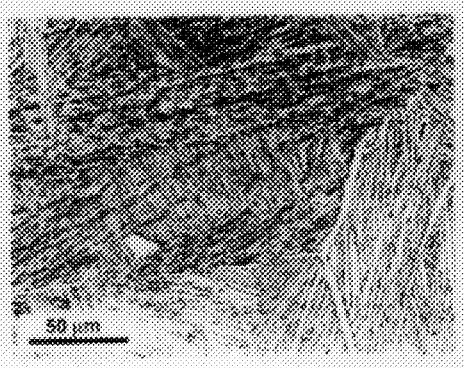
FIG. 27 is an optical micrograph of the HT3-processed (beta annealed and aged) microstructure within a Ti-6242S sheet sample.
Figure 29:
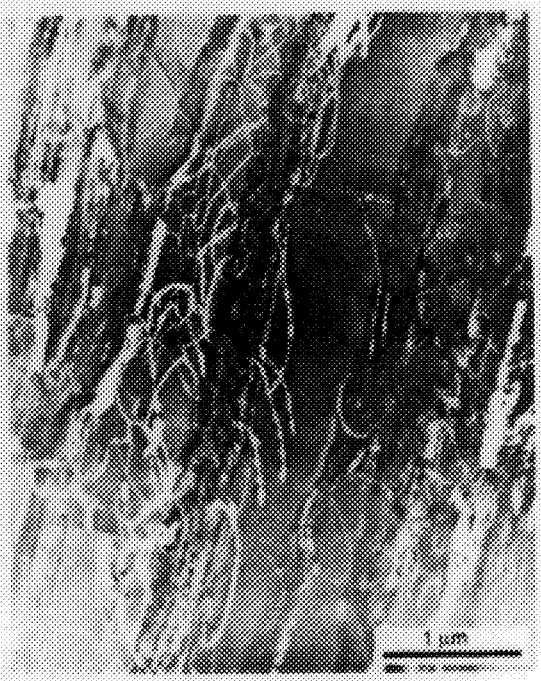
FIG. 29 is a TEM image $g=[1120]_\alpha$ showing moderate dislocation densities in successive alpha plates and beta strips subject to HT3 processing (beta annealing and aging) of Ti-6242S sheet sample, with no evidence of beta phase decomposition.
Figure 28:
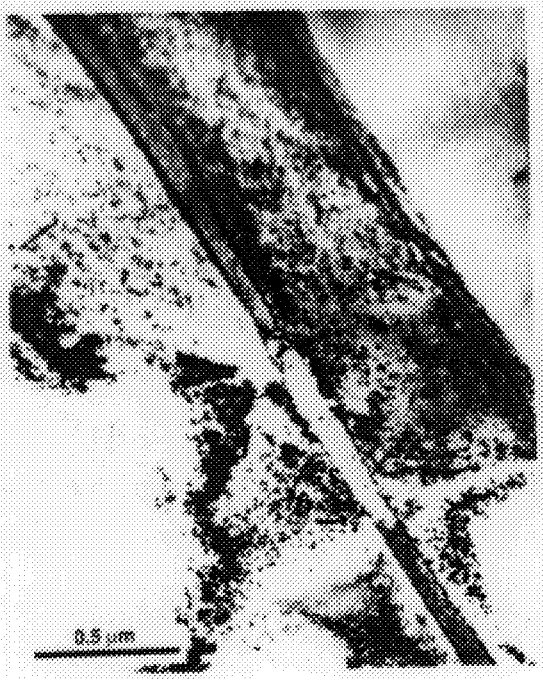
FIG. 28 is a TEM image showing a beta strip sandwiched between two alpha laths within the transformed non-decomposed beta phase subject to HT3-processing (beta anneal and age) of a Ti-6242S sheet sample.
Figure 30:
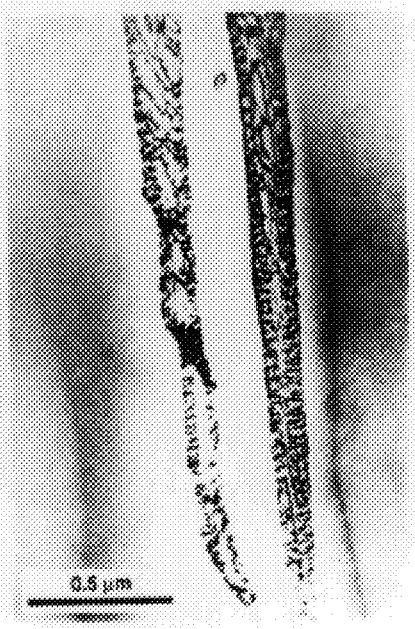
FIG. 30 is a TEM image showing beta strips with a high dislocation density in HT3-processed (beta annealed and aged) Ti-6242S sheet sample.
Figure 31:
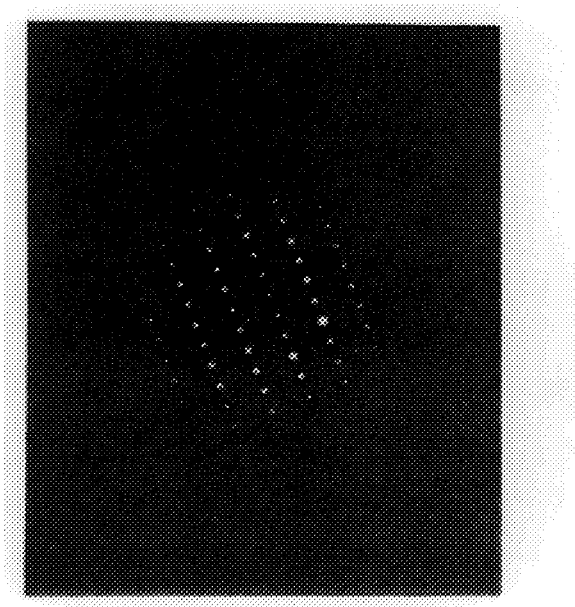
FIG. 31 is a $[1120]_\alpha$ diffraction pattern in the alpha phase of transformed beta showing no evidence of ordering to alpha-2 within an HT3-processed (beta annealed and aged) Ti6242S sheet sample.

The sample (FIG. 27) was solution treated at 1875° F. (above the beta transus) followed by an age treatment at 1100° F. Optical microscopy showed a fully-transformed structure with a very large prior beta-grain size. TEM revealed no obvious silicide particles in the microstructure (see FIGS. 28 and 29). The alpha-phase plates and beta strips showed moderate dislocation densities (FIGS. 29 and 30), and no decomposition of the beta phase. The diffraction pattern within the alpha phase (as shown in FIG. 31), revealed no evidence of ordering to $\alpha_2$.

1450° F.—Aged Microstructure After Duplex Anneal (HT4)

Figure 12:
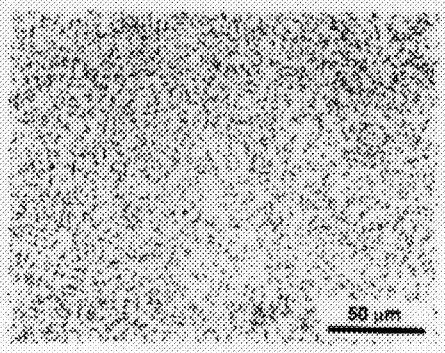
FIG. 12 is a sectional view of the microstructure of HT1 duplex annealed (as received) rolled titanium alloy sheet (longitudinal orientation) showing an alpha-beta mixture.
Figure 13:
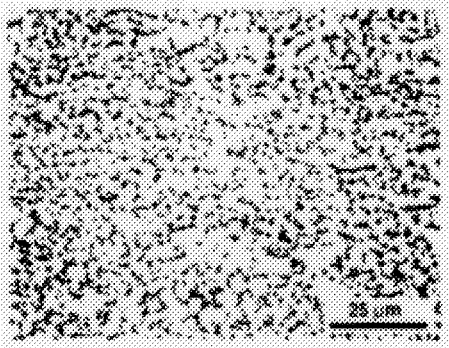
FIG. 13 is a sectional view of the HT1 duplex annealed titanium alloy sheet shown in FIG. 13 at a magnification of 1000 times.
Figure 14:
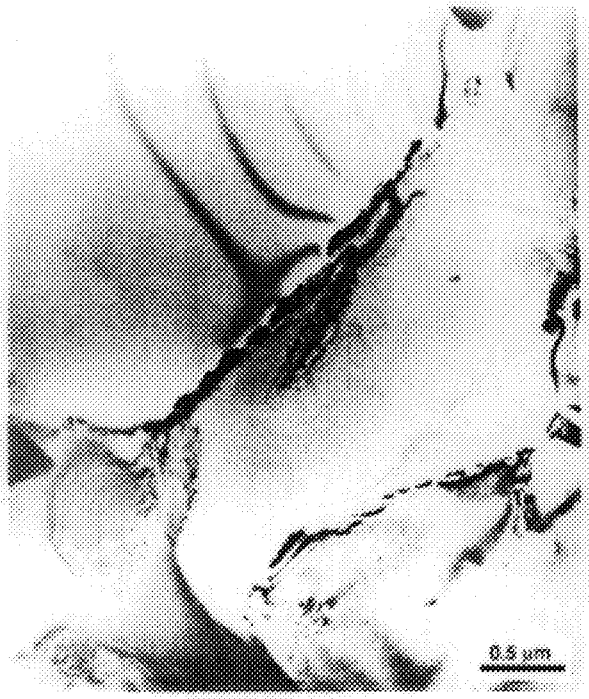
FIG. 14 is a TEM micrograph of HT1 processed duplex annealed titanium alloy sheet showing small silicide precipitates at primary alpha—alpha grain boundaries.
Figure 32:
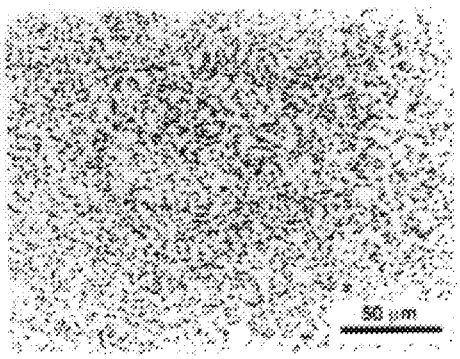
FIG. 32 is an optical micrograph showing the microstructure of an HT4-processed sample of Ti-6242S sheet (overaged at 1450° F. following a prior duplex anneal per HT1). Note that the sample plane of polish is longitudinal.
Figure 33:
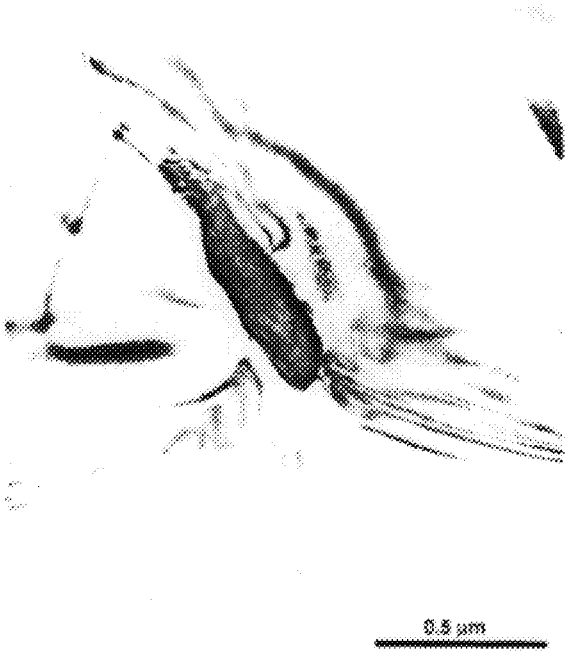
FIG. 33 is a TEM image showing coarsened silicides (size 0.7 $\mu$m) along the alpha-alpha boundaries within an HT4 processed sample of Ti6242S sheet. Overall silicide size range of from 0.5 $\mu$m to 1 $\mu$m.
Figure 34:
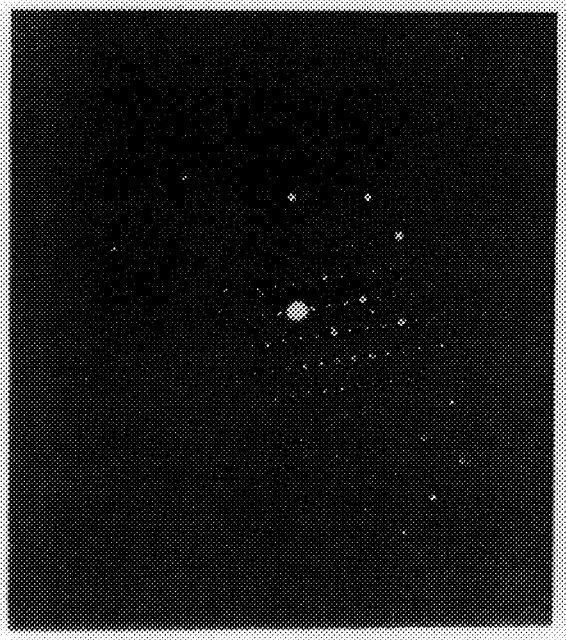
FIG. 34 shows a diffraction pattern $[1120]_{3n}$ for the silicide appearing in FIG. 33.
Figure 36:
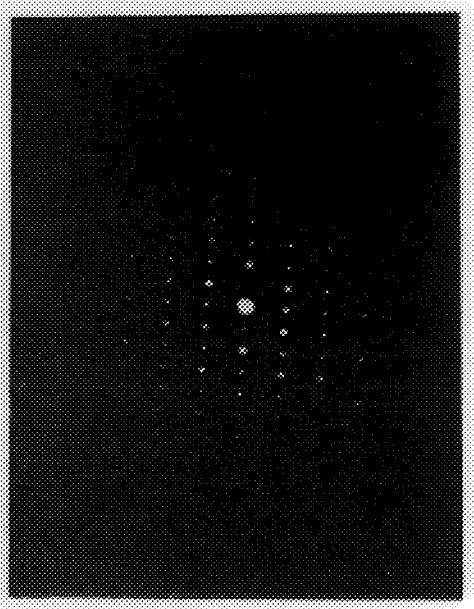
FIG. 36 is a $[1120]_\alpha$ diffraction pattern showing no alpha-2 phase presence in the alpha phase (no superlattice pattern) subject to HT4 processing in Ti-6242S sheet.
Figure 35:
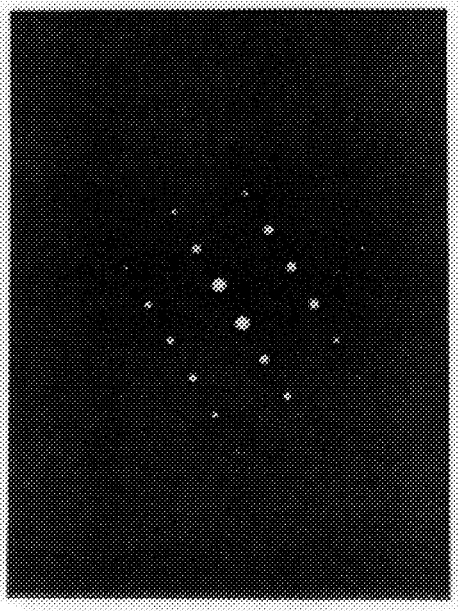
FIG. 35 is a $[311]_\beta$ diffraction pattern showing no $\omega$ phase presence in beta phase exposed to HT4 processing (overage at 1450° F. following a prior duplex anneal per HT1) in Ti-6242S sheet.
Figure 37:
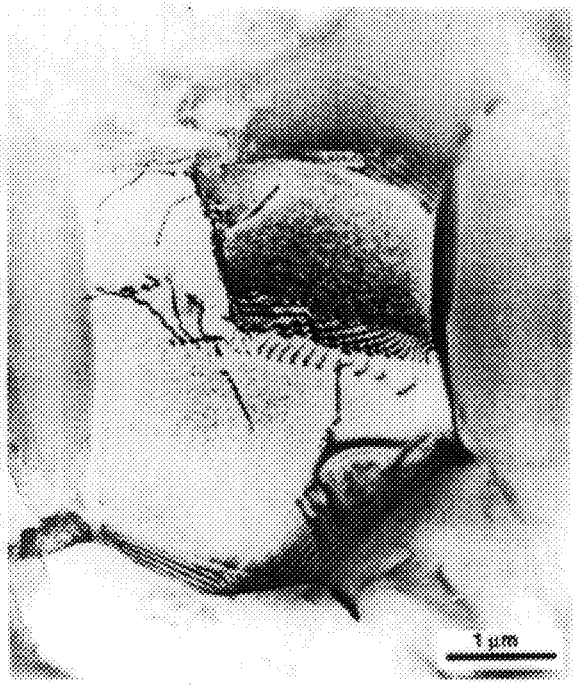
FIG. 37 is a dark field TEM image $g=[1120]_\alpha$ showing no alpha-2 ordered phase presence and indicating evidence of dislocation cell walls within the primary alpha grains with a relatively low dislocation density being confined to alpha-phase subboundaries.
Figure 38:
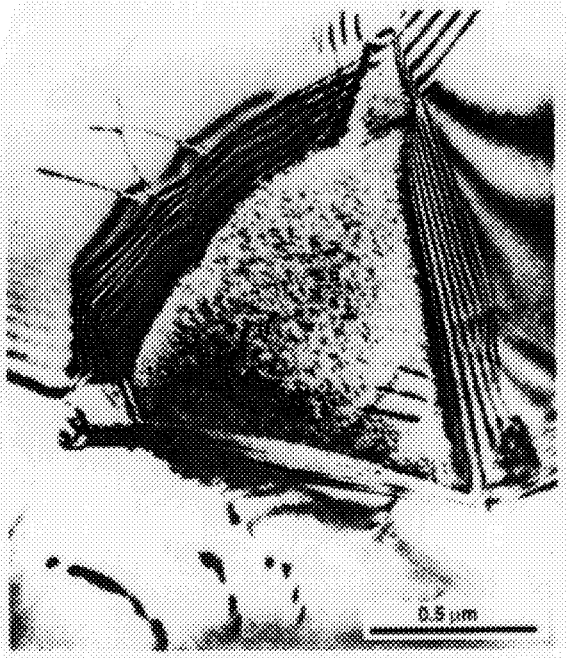
FIG. 38 is a tilted TEM image (for dislocation viewing) showing virtually no dislocations within the beta phase (triangular beta patch in the center) in an HT4-processed sample of Ti-6242S sheet.
Figure 39:
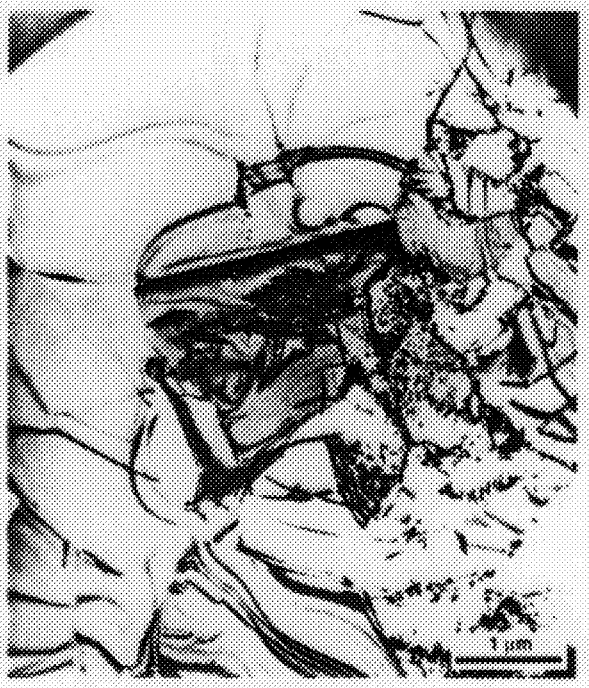
FIG. 39 is a TEM image showing some limited decomposition within the beta phase in HT4-processed Ti-6242S sheet.
Figure 40:
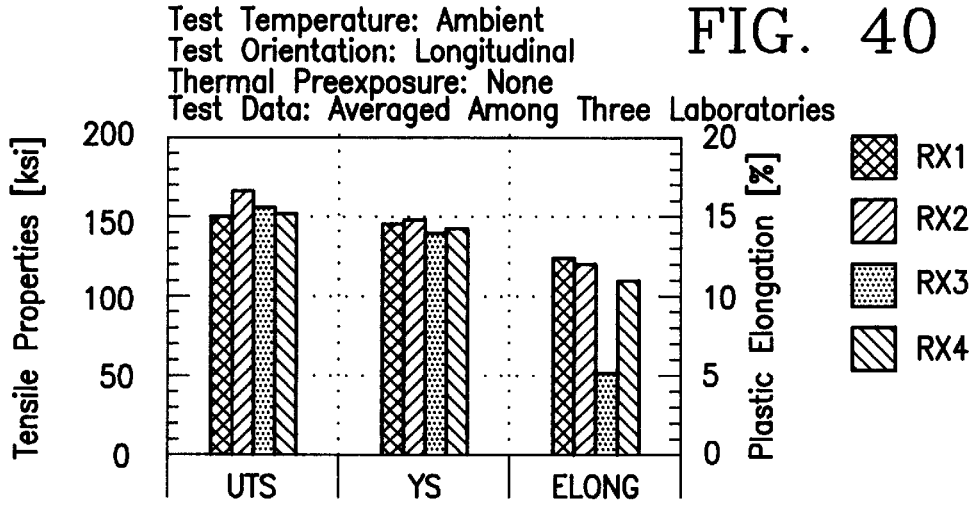
FIG. 40 is a comparison of room temperature tensile properties of four modifications of Ti-6242S titanium alloy.
Figure 41:
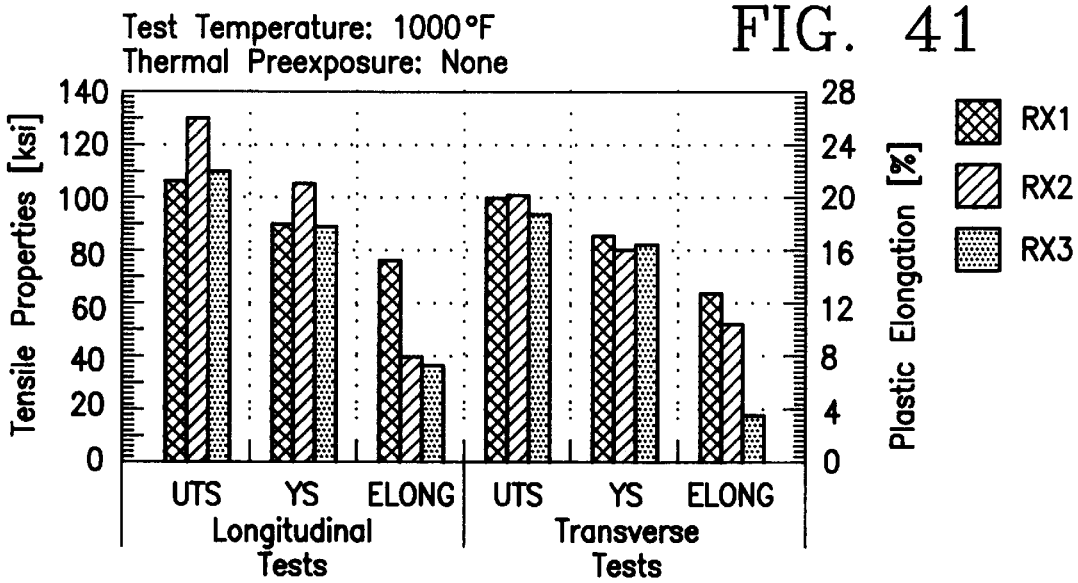
FIG. 41 is a comparison of 1000° F. tensile properties of three modifications of Ti-6242S titanium alloy.
Figure 42:
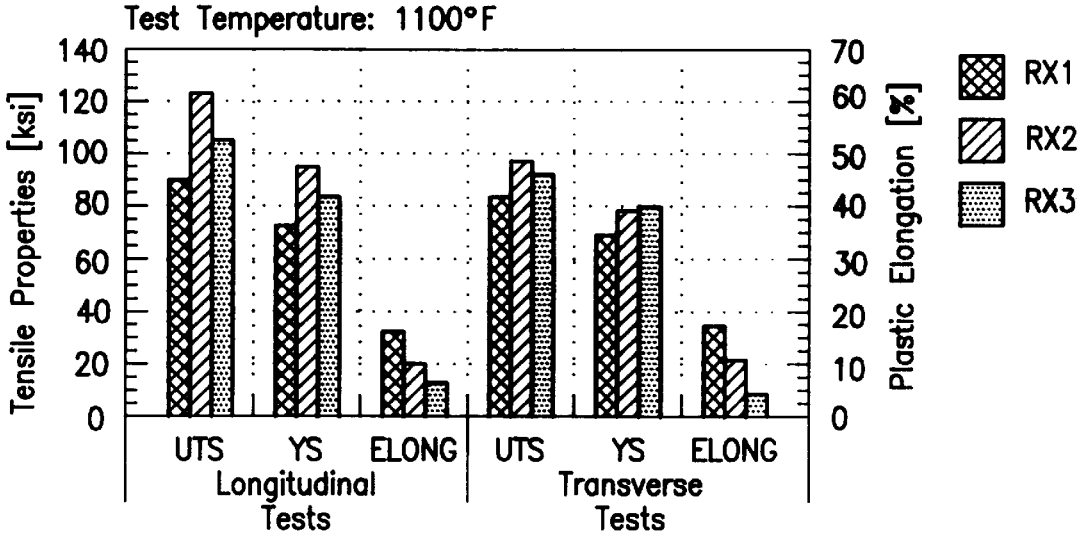
FIG. 42 is a comparison of 1100° F. tensile properties of three modifications of Ti-6242S titanium alloy.
Figure 43:
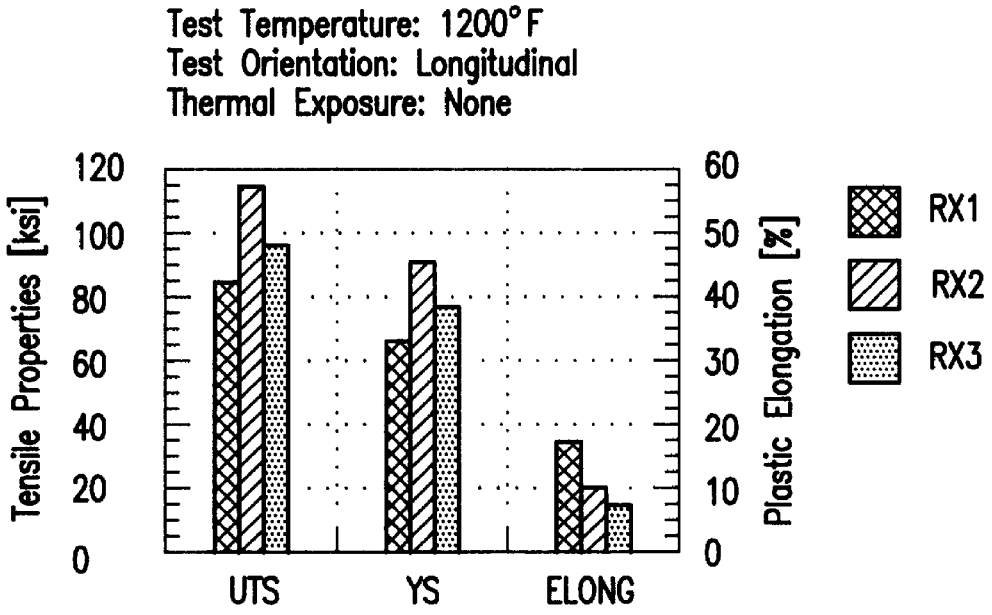
FIG. 43 is a comparison of 1200° F. tensile properties of three modifications of Ti-6242S titanium alloy.

This sample (FIG. 32) was solution treated at 1650° F. and then aged for a long time at 1450° F. Optical micrographs showed a microstructure similar to the sample in FIGS. 12 and 13. TEM revealed silicide particles on the order of 0.5 to 1.0 $\mu$m, mainly at alpha—alpha boundaries (see FIGS. 33 and 34). Electron diffraction patterns showed neither omega nor alpha-2 phases in this microstructure (FIGS. 35 and 36). While the alpha phase showed some dislocations formed into subboundaries (FIG. 37), the beta phase showed much fewer dislocations (FIG. 38). There is occasional precipitation of alpha phase within some of the beta gains (FIG. 39).

MIL-H-81200B Solution Treat and Ace (HT5)

This sample microstructure was not examined in detail by electron microscopy because of the close similarities to HT1, and as such it appears to have the precipitated silicides with no alpha-two phase precipitation.

MECHANICAL TEST VERIFICATION OF HEAT TREAT OPTIMIZATION

For the RX2 technology demonstrator alloy Ti-6242S, the evaluated material properties included (a) tensile properties from −200° F. to 1200° F.; (b) tensile elastic modulus at room temperature only; (c) creep properties at 900° F., 1100° F., and 1200° F. at stress levels in the range of 25 ksi to 100 ksi in air and argon environments with reduced stress levels at the higher temperature; (d) casual hydrogen compatibility; and (e) thermal stability testing at exposure temperatures of 1100° F., 1200° F., and mission simulation cycling; (f) plane stress fracture toughness at room temperature only in center cracked sheet specimens for $K_c$ and $K_{app}$; and (g) constant amplitude fatigue testing (S/N curve) in sheet specimens per FIG. 11. Table 5 shows the distribution of test matrix per heat treat condition (HT1 through HT5). In the discussion that follows, reference will be made to the alloy modifications RXY, where Y=1 for thermomechanical processing pathway terminating with HT1, Y=2 for pathways with HT2 as the final step, etc.

In conducting the tests described in Table 5, the overall objective was to determine the best method or "pathway" for thermomechanical processing/heat treatment for selected advanced titanium alloys in order to obtain the following simultaneous improvements in material properties as compared with the properties obtained with typical mill processing:

(1) Improve the overall tensile property balances at all use temperatures.

(2) Increase the alloy stiffness (elastic modulus).

(3) Eliminate the ductile-to-brittle transition down to −200° F.

(4) Improve the fracture toughness of the given alloy to essentially maximum limit while maintaining the highest strength level.

(5) Increase the alloy's thermal stability and hydrogen embrittlement resistance.

(6) Enhance the creep resistance.

(7) Improve fatigue resistance (smooth bar data).

(8) Determine optimum processing-microstructure-property relations and extend the applicability of the best method to other product forms and other titanium alloys.

(A) Tensile Properties and Elimination of the Ductile-to-Brittle Transition Down to −200° F.

In Table 6 (below) and FIGS. 40–44 comparisons are made between five thermomechanical processing/heat treatment alloy modifications, "RX1", "RX2", "RX3", "RX4" and "RX5", with the first modification RX1 representing standard mill processing and the last modification RX5 representing processing according to MIL-H-81200.

TABLE 5

Evaluation Test Matrix for the RX2 Methodology demonstrator alloy Ti 6242S Sheet(α/β final Rolled by RMI)

| Ti-6242S Material Heat Treat Condition | Tensile Testing (1) | Creep Testing (2) | Thermal Stability | $H_2$ Compatibility (3) | Elastic Modulus (4) | Fracture Toughness (5) | Fatigue (6) |
|---|---|---|---|---|---|---|---|
| HT1(α/β duplex-annealed | X | X | X | | X | X | X |
| HT2 (Subtransus annealed and aged) | X | X | X | X | X | X | X |
| HT3 (β-annealed) | X | X | X | X | | | |
| HT4 (Stabilized overaged) | X | | | X | | | |
| HTS(per MIL-H-81200) | X | | | | X | | X |

Notes:

1. Tensile tests: In duplicate longitudinal and transverse, at −200° F., −100° F., RT, 1,000° F., 1,200° F., and In-situ tensile tests per ASTM Standards Eg and E21
2. Creep tests: full creep curves at least up to a steady state secondary creep rate (900° F., 1,100° F., and 1,200° F.)
3. Hydrogen charging conditions: 1,200° F/15 torr/3 br and 1,200° F./4 torr/3 hr
4. Elastic modulus was measured using three methods at three different laboratories: Standard method of dual extensometer per ASTM E111, autographic stress-strain records per ASTM E8, and strain gage method applied to both faces of flat sheet specimens per ASTM E251.
5. Plane-stress fracture toughness testing using center-cracked tension sheet specimens measuring 0.060" × 5.5" × 16 per ASTM Standard Method E561
6. Constant amplitude fatigue tests using sheet specimens per ASTM E466

TABLE 6

Correlations of Room Temperature Tensile Properties of Rockwell's "RXY" Alloy Modifications of a Commercial Alpha/Beta Titanium Alloy as Measured by Four Different Laboratories

| Test Specimen Identification | Test Orientation | Processing Condition | Test Laboratory** | Tensile Yield Stress [ksi] | Ultimate Tensile Strength [ksi] | Elongation [%] | Elastic Modulus [Msi] |
|---|---|---|---|---|---|---|---|
| Lot Certificates | Longitudinal | RX1 | RMI | 145.9 | 147.8 | 11.0 | — |
| 4L67/4L92 | Longitudinal | RX1 | RI(STSD) | 145.8 | 152.3 | 13.6 | 20.49 |
| 4L40 | Longitudinal | RX1 | WMT&R | 149.0 | 160.2 | 12 | 19.2 |
| Lot Certificates | Transverse | RX1 | RMI | 139.5 | 144.9 | 11.3 | — |
| 4T16 | Transverse | RX1 | RI(STSD) | 135.9 | 143.5 | 11.50 | 18.9 |
| 4T28 | Transverse | RX1 | WMT&R | 134.8 | 143.7 | 15 | 17.5 |
| 4T65 | Transverse | RX1 | METCUT | 135.0 | 144 | Not Available | 16.8 |
| 4L1/4L9 | Longitudinal | RX2 | RI(STSD) | 145.4 | 165.1 | 11.9 | 21.5 |
| 4L50 | Longitudinal | RX2 | WMT&R | 151.9 | 167.4 | 12.0 | 19.5 |
| 4T1/4T12 4T13/4T17& AT72 AVER | Transverse | RX2 | RI(STSD) | 125.1 | 140.7 | 9.5 | 19.3 |
| 4T11 | Transverse | RX2 | WMT&R | 126.5 | 142.7 | 10.0 | 19.2 |
| 4T70 | Transverse | RX2 | METCUT | 126.0 | 140.0 | 9.0 | 16.7 |
| 4L125/4L7& 4L168 | Longitudinal | RX3 | RI(STSD) | 138.7 | 156.6 | 8.9 | 20.86 |
| 4L38 | Longitudinal | RX3 | WMT&R | 147.3 | 159.5 | 5.0 | 19.9 |
| 4L4/4L120 | Longitudinal | RX4 | RI(STSD) | 144.9 | 152.7 | 11.10 | 20.04 |
| 4T7 | Transverse | RX4 | RI(STSD) | 133.9 | 144.2 | 7.73 | 18.73 |
| 4L157 | Longitudinal | RX5 | METCUT | 150.0 | 152.0 | 3.2 | 18.8 |
| 4L155 | Longitudinal | RX5 | WMT&R | 148.7 | 157.9 | 12.0 | 19.0 |

Notes:
*One alloy modification namely RX1 was mill-processed by the Supplier. All other modifications were Rockwell-processed
**WMT&R: Westmoreland Mechanical Testing and Research, Inc., Youngstown, Pa
RI(STSD): Rockwell International Corporation, Space Transportation Systems Division, Downey, Ca
Metcut: Metcut Research Associates, Cincinnati, Ohio
RMI: Reactive Metals Inc., Niles, Ohio From this information, the following observations can be made:

(1) For all heat treatments, the longitudinal orientation exhibited higher strength and ductility combinations than the transverse orientation (anisotropy factor is 15 to 20 percent).

(2) The subtransus (HT2) heat treatment with RX2 processing, compared to the duplex-annealed condition (HT1), improved the ultimate strength by about 15 ksi (or 10 percent) while retaining the room temperature tensile ductilities at nearly the same high levels of the duplex-annealed condition for both test orientations.

(3) At elevated temperatures in the range of 1000° F. to 1200° F. (FIGS. 41–43), tests showed RX2 processing to increase the tensile strength of the alloy by 20% to 35% beyond that achieved by the material supplier's mill processing, while maintaining a reasonable ductility level (elongation 8% to 11%).

(4) The cryogenic properties of Ti-6242S alloy were compared for two heat treatments: HT2 (RX2 modification) without suicides but with partially decomposed beta microstructure, and HT4 (RX4 modification) with coarsened suicides but virtually no decomposition within the beta microstructure.

Figure 44:
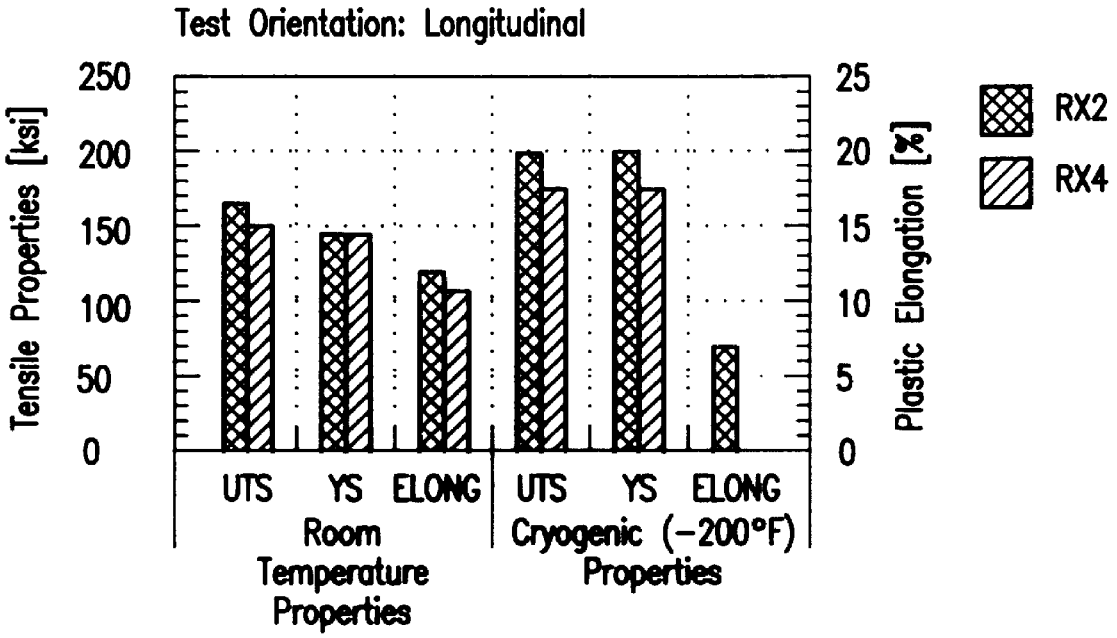
FIG. 44 is a comparison of room and cryogenic (−200° F.) temperature tensile properties of two modifications of Ti-6242S titanium alloy.
Figure 45:
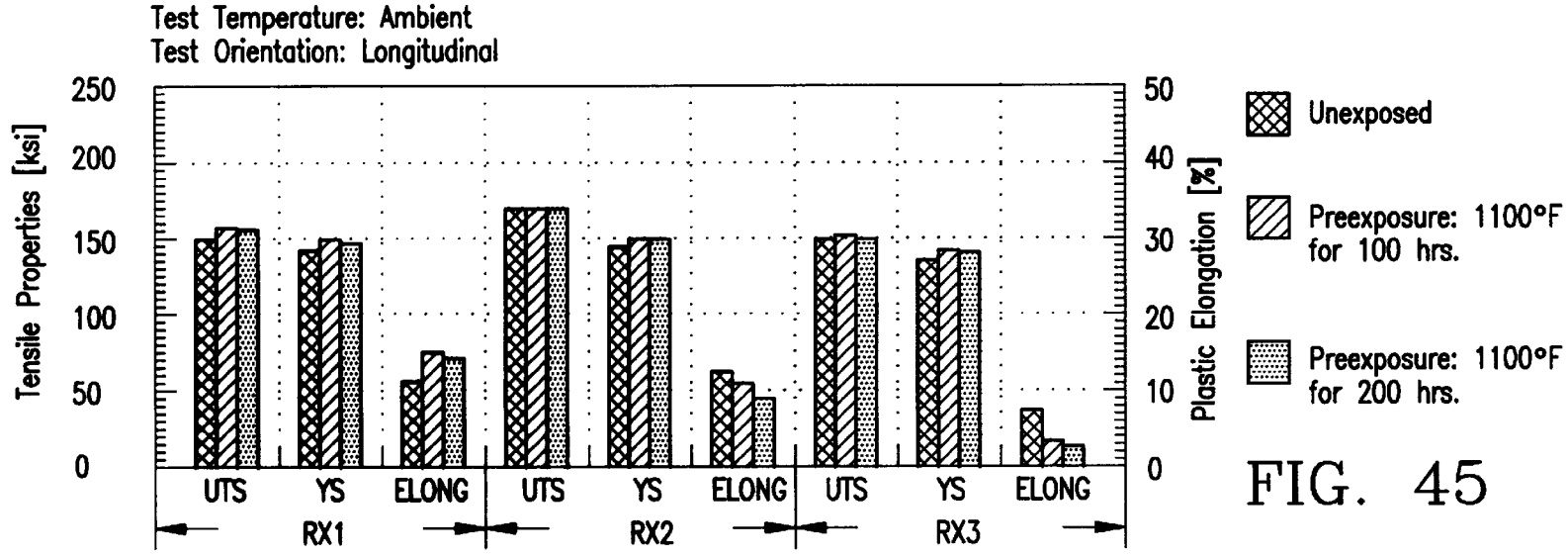
FIG. 45 is a comparison of three modifications of Ti-6242S titanium alloy in terms of thermal stability at 1100° F. for longitudinal tests at room temperature.
Figure 46:
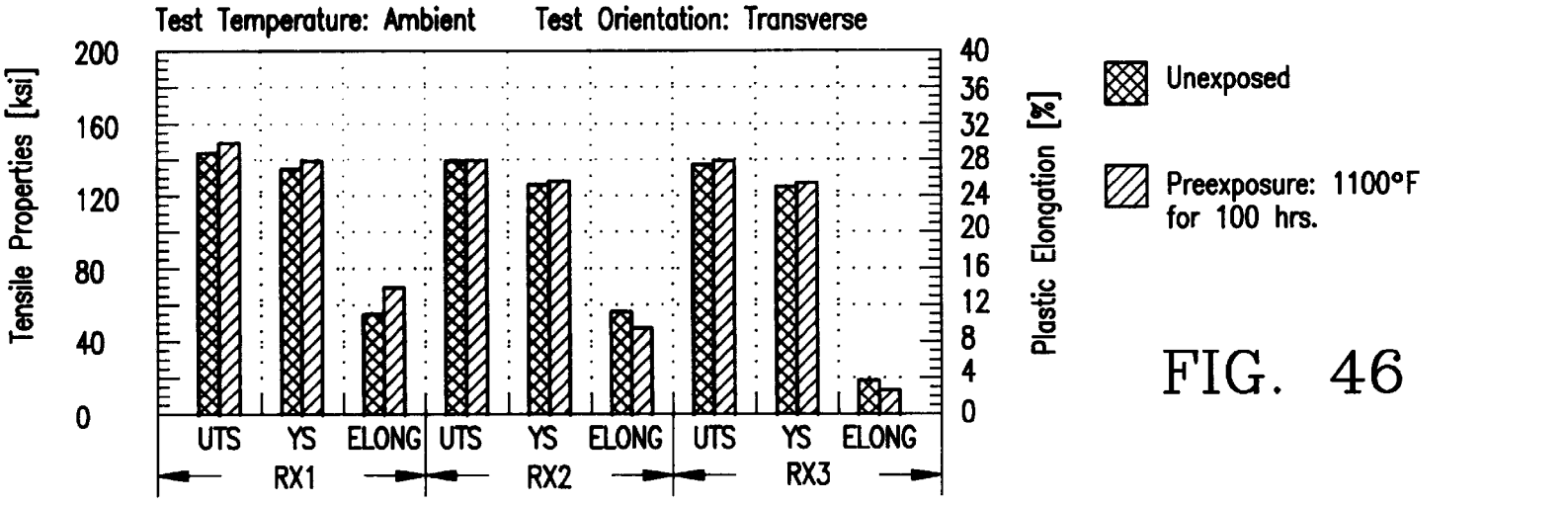
FIG. 46 is a comparison of three modifications of Ti-6242S titanium alloy in terms of thermal stability at 1100° F. for transverse tests at room temperature.

FIG. 44 compares tensile properties observed in longitudinal test orientations for both heat-treatment conditions. It is clear that the silicide-free heat treatment (HT2) is far superior to the elevated-age (1450° F.) treatment containing coarsened silicide (HT4), particularly in terms of fracture ductility and, hence by inference, cryogenic fracture toughness.

(B) Elastic Modulus Improvement

In view of the sensitivity of this property to measurement errors and equipment calibrations, several techniques and test laboratories were used as shown in Table 7.

TABLE 7

Average Longitudinal Elastic Modulus Measurements in Differently Processed RXY Titanium Alloy Modifications Conducted at Three Laboratories Using Several Specimens and Test Methods

| Test Specimen and Condition | Test(*) Laboratory | Test Method (No of tests) | ASTM Test Standard | Average Elastic Modulus [Msi] Multiple Readings per specimen & Test Method | Average Elastic Modulus [Msi] Same Method, Different Laboratories | Average Elastic Modulus [Msi] Multiple Specimens, Test Methods, and Laboratories |
|---|---|---|---|---|---|---|
| RX1 | WMT&R | Dual Extensometer (1) | ASTM E111 | 18.4 | 18.4 | 18.5 Average of ten tests |
| | WMT&R | Strain Gages (Two Sides) (3) | ASTM E251 | 17.22 | 17.75 | |
| | Metcut | Strain Gages (Two Sides) (3) | ASTM E251 | 18.27 | | |
| | WMT&R | Tensile Test (1) | ASTM E8 | 19.2 | 20.07 | |
| | RI(STSD) | Tensile Test (1) | ASTM E8 | 19.9 | | |
| | RI(STSD) | Tensile Test (1) | ASTM E8 | 21.10 | | |
| RX2 | WMT&R | Dual Extensometer (1) | ASTM E111 | 18.9 | 18.9 | 19.6 Average of ten tests |
| | WMT&R | Strain Gages (Two Sides) (3) | ASTM E251 | 18.60 | 18.4 | |
| | Metcut | Strain Gages (Two Sides) (3) | ASTM E251 | 19.53 | | |
| | WMT&R | Tensile Test (1) | ASTM E8 | 19.5 | 20.85 | |
| | RI(STSD) | Tensile Test (1) | ASTM E8 | 21.86 | | |
| | RI(STSD) | Tensile Test (1) | ASTM E8 | 21.19 | | |

Notes:
(*)WMT&R: Westmoreland Mechanical Testing and Research Inc., Youngstown, Pa
Metcut: Metcut Research Associates, Cincinnati, Ohio
RI(STSD): Rockwell International Corporation, Space Transportation Systems Division, Downey, Ca The final values based on averages of ten tests each for the mill processing method (RX1), and the newly processed RX2 modifications indicate that the latter processing method provides about 6% improvement in the elastic modulus.

(C) Thermal Stability Demonstration Testing

To investigate the thermal stability behavior of Ti6242S, room-temperature and 1100° F. tensile properties were compared for the three heat treatment conditions (duplex annealed HT1, subtransus solution and aged (HT2), and beta solution and aged (HT3)) described earlier. Specimens in each of these heat-treatment conditions were further subjected to one of several thermal exposures:

Isothermal exposures
- 1100° F. at 100 hours
- 1100° F. at 200 hours

Thermal mix equivalents per Equation (15)
- Five missions: 1.25 hours at 1200° F. plus 1.25 hours at 900° F. plus 8.33 hours at 1100° F.
- Twenty missions: 5 hours at 1200° F. plus 5 hours at 900° F. plus 33.3 hours at 1100° F.

Thermal cycling
- Fifteen individual thermal cycles:
  - five cycles at 900° F., 1100° F., 1200° F. with a 15 minute hold at peak temperature in each case.

To isolate the effects of temperature from those of ambient oxygen and nitrogen, all exposures noted above were carried out in a dynamic vacuum environment with a vacuum pressure less than 10–5 Torr. The following summary of observations were made with reference to FIGS. 45–48 which present only salient features of the overall test matrix findings:

(1) For the 1100° F./100 hour exposure (FIGS. 45 and 46), in comparison with unexposed similar specimens tested at ambient temperature, the duplex annealed longitudinal and transverse specimens (HT1) showed virtually no degradation of properties, and if anything a slight enhancement of both strength and ductility. The subtransus heat treatment (HT2) showed virtually no change in strength and/or ductility, whereas the beta heat-treated specimens showed a substantial drop in ductility (about 35 to 40 percent) with a slight increase in strength.

(2) For the 1100° F./200 hour exposure (FIG. 45), the duplex annealed condition (HT1) showed no degradation, and if anything a slight enhancement in both room-temperature strength and ductility by a few percent. The specimens subjected to subtransus heat treatment (HT2) and tested at room temperature exhibited a moderate drop in ductility (from 12.36% to 8.72%, which remains acceptable) with virtually no change in the strength level. By contrast, the beta heat-treatment condition (HT3) showed a large drop in ductility (from 7.44% to 2.6%) with virtually no significant change in strength.

(3) In the 20-mission equivalent exposure (FIGS. 47 and 48), versus similar unexposed specimens, the duplex-annealed condition (HT1) showed virtually no change in ductility along with a slight gain in strength level. The subtransus heat treatment (HT2) showed a slight increase in ductility but no change in strength level. By contrast, the beta heat treatment (HT3) again showed a large drop in ductility (from 7.44% to 1.26%) with little or no change in strength levels.

(4) For the 15 thermal cycle applications, the duplex-annealed condition (HT1) showed a slight increase in both strength and ductility (a few percent). The subtransus heat treatment (HT2) showed no change in strength and/or ductility, while the beta heat treatment (HT3) showed a substantial drop in ductility (from 7.44% to 4.30%) with virtually no change in strength level.

(5) The effect of thermal preexposure on elevated-temperature (1100° F.) tensile properties indicated the following trends:

a. For the duplex (HT1) and subtransus (HT2) heat treatments, the material experienced an initial increase in ductility at the 100 hr point with the same strength level; the ductility level dropped back to the original (unexposed value) at 200 hr with a slight increase in strength (overall, there was no significant degradation effect).

b. The five-mission-mix equivalent thermal exposure did not result in any significant degradation of high-temperature tensile properties.

From the foregoing observations, it is clear that duplex annealing (HT1) and subtransus heat treatment (HT2) are much more thermally stable conditions than the beta heat-treatment condition (HT3).

Figures 47, 48, 49:
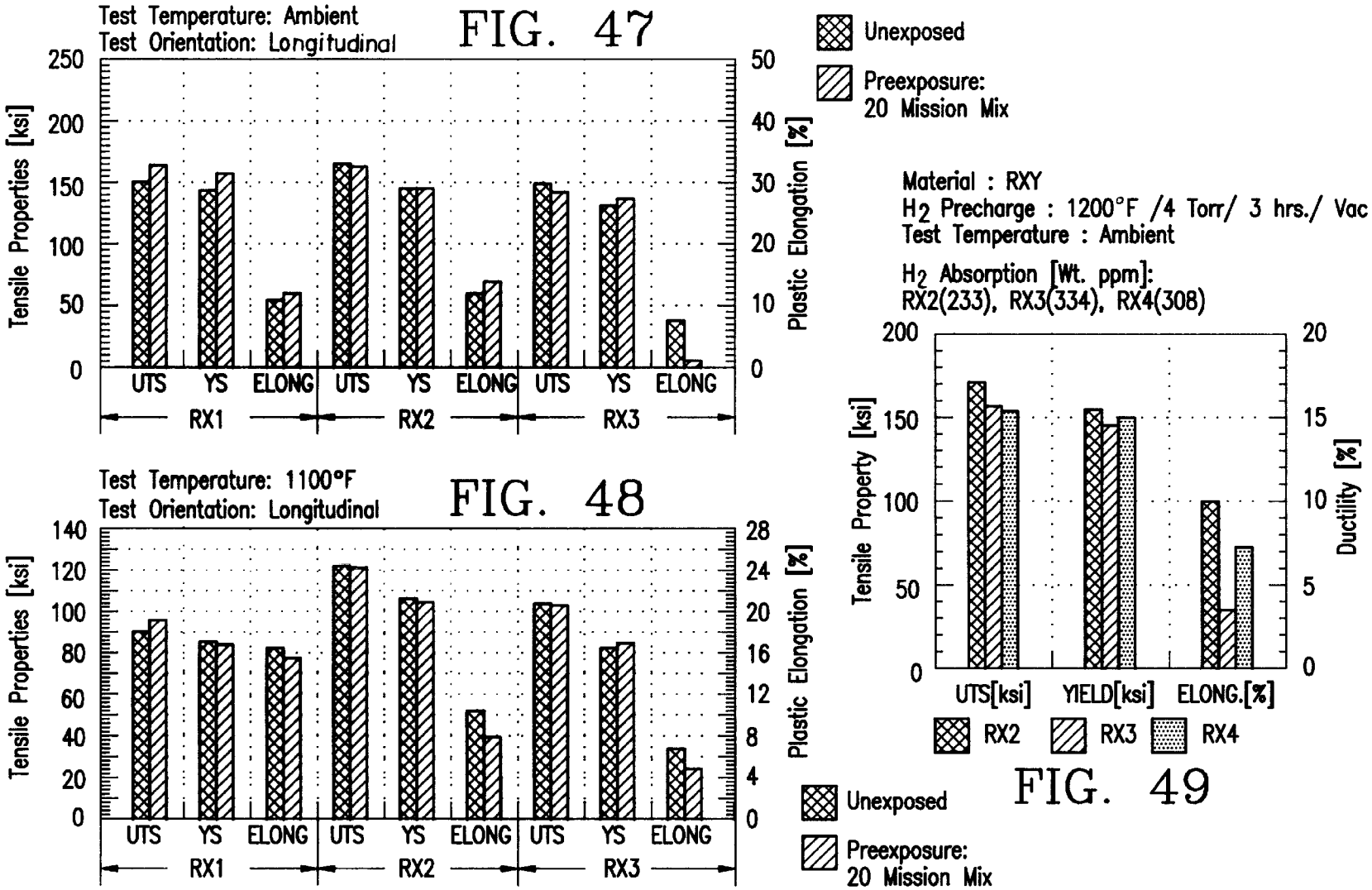
FIG. 47 is a comparison of three modifications of Ti-6242S titanium alloy in terms of thermal stability following 20 mission mix exposures at temperatures up to 1200° F. for tests at ambient conditions.
FIG. 48 is a comparison of three modifications of Ti-6242S titanium alloy in terms of thermal stability following 20 mission mix exposures at temperatures up to 1200° F. for tests at 1100° F.
FIG. 49 is a comparison of three modifications of Ti-6242S titanium alloy in terms of internal hydrogen embrittlement resistance at room temperature.

However, from the standpoint of high temperature strength at 1100° F., FIG. 48 shows that RX2 has a superior high temperature strength following a 20 mission exposure regime compared with the RX1 heat treatment. It follows therefore that the RX2 modification is the best modification for the demonstrator alloy Ti-6242S application for long-term thermal stability.

Using Equation (15) for "equivalent" long term thermal aging exposure, for example at the anticipated HSCT maximum use temperature of 350° F., it has been shown that a 100 hour exposure at 1100° F. translates into millions of hours which exceed the duration of any aircraft life.

(D) Improvement of Fracture Toughness

Table 8 below shows a dramatic improvement in the plane stress fracture toughness of Ti-6242S with RX2 processing (subtransus annealed and aged following thermomechanical processing per FIG. 5 pathways).

TABLE 8

Correlation of Plane-Stress Fracture Toughness Test [1]Results for Differently Processed RXY Alloy Sheets Tested per ASTM E561 (R-Curve Analysis)

| Specimen[2] Designation | Test Orientation | Heat Treat Processing | Kapp [ksl · Inch$^{1/2}$] | Kc [ksl · Inch$^{1/2}$] |
|---|---|---|---|---|
| 4LT2 | L-T | RX1 | 77.5 | 93.3 |
| 4LT1 | L-T | RX2 | 170.4 | 227.4 |

Notes:
[1]Tests were conducted at Westmoreland Mechanical Testing and Research Inc, Youngstown, Pa
[2]Tests were based on center-cracked tension (CCT) specimen measuring 0.06" × 5.5" × 16"

With the RX2 processing, the alloy fracture toughness more than doubled in comparison with the mill duplex annealed condition (RX1/HT1). Fracture toughness is generally dependent on the microstructure. Major differences in microstructure between RX1 and RX2 were noted earlier from which the following salient features should be noted:

a. RX1 has grain boundary silicides, whereas RX2 has none.

b. RX1 has a discontinuous beta phase in an equiaxed alpha grain matrix, whereas RX2 has a triplex microstructure consisting of equiaxed primary alpha grains and elongated secondary alpha grains in a beta matrix.

c. RX1 alpha phase has no precipitated (ordered) alpha-two, whereas the primary alpha in RX2 is strengthened by ordered alpha-two particles.

How these differences in microstructure affect the fracture toughness will be discussed below under the topic of "Discussion".

(E) Improvement of Hydrogen Embrittlement Resistance

Figure 50:
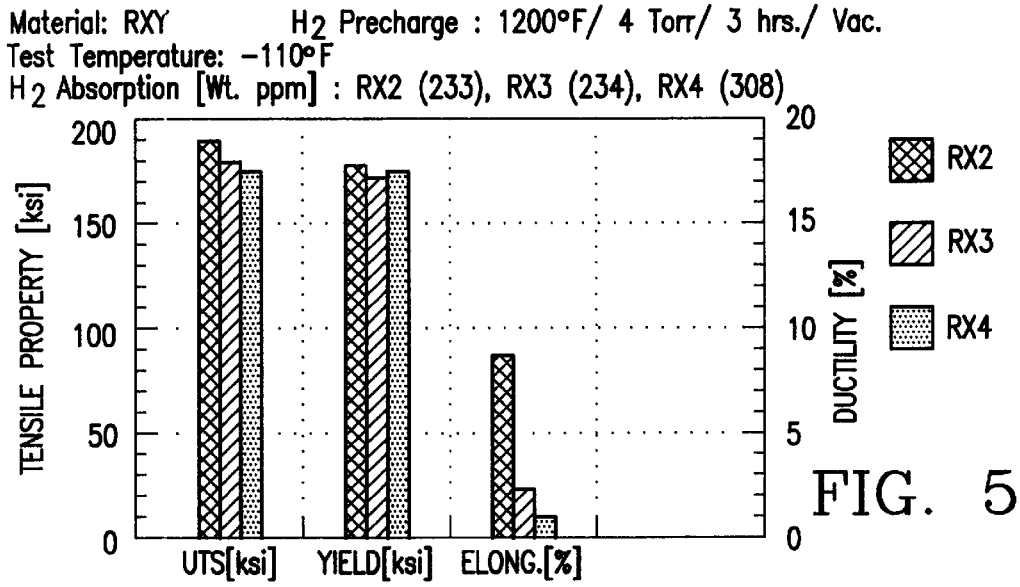
FIG. 50 is a comparison of three modifications of Ti-6242S titanium alloy in terms of internal hydrogen embrittlement resistance at −110° F.
Figure 51:
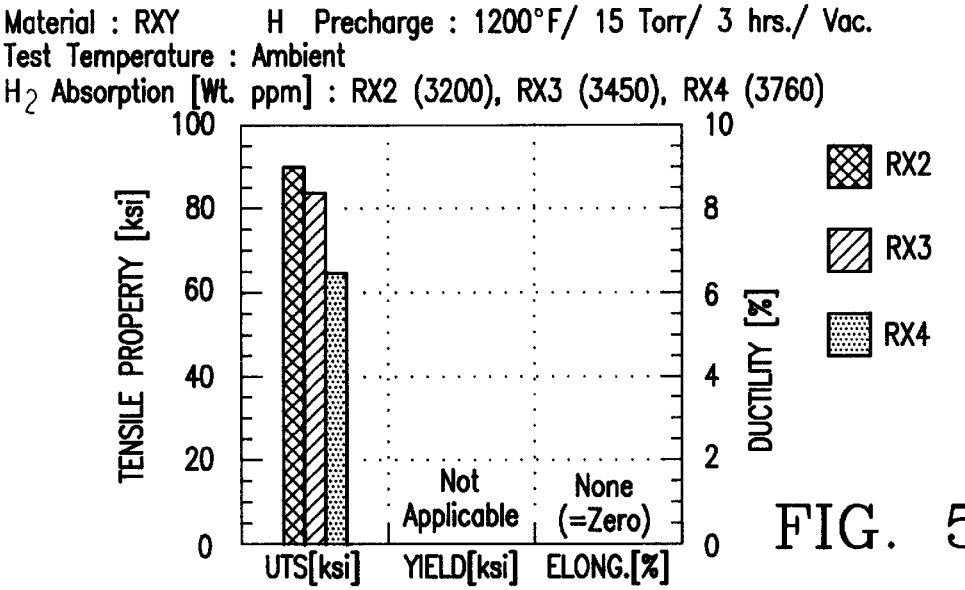
FIG. 51 is a comparison of three modifications of Ti-6242S titanium alloy in terms of internal hydrogen embrittlement resistance at room temperature.
Figure 52:
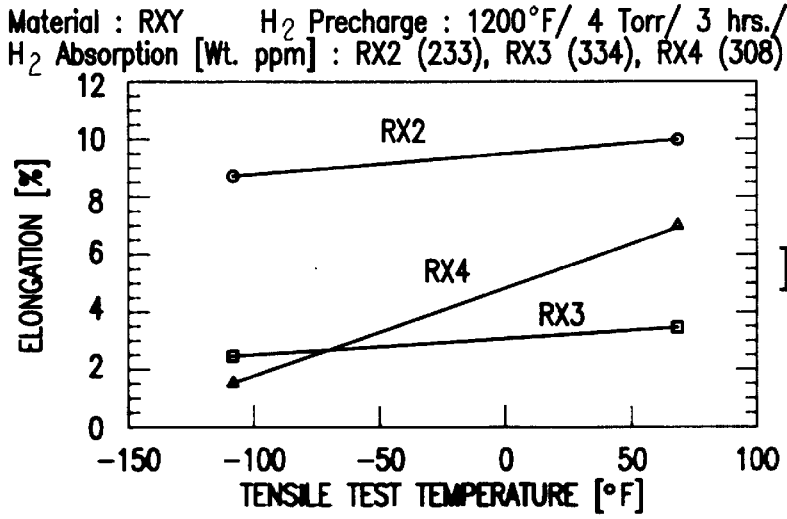
FIG. 52 is a characterization of cryogenic hydrogen-assisted ductile-to-brittle transition behavior of three modifications of Ti-6242S titanium alloy.

Susceptibility to internal hydrogen embrittlement was considered among three alloy modifications of Ti-6242S by exposing processed polished and cleaned smooth tensile specimens at the maximum anticipated use temperature for a time sufficient to saturate the specimens with hydrogen (about 3 hours of low-pressure hydrogen precharge at 1200° F. in the pressure range of 4–15 Torr of hydrogen).The impact of such exposures on embrittlement resistance was evaluated by comparing the tensile ductility changes among gas precharged versus uncharged as manifested by the tensile elongation % drop in smooth tensile sheet specimens (FIG. 11), using standard ASTM testing at a strain rate of 0.005 inch/inch/minute at ambient and cryogenic (−110° F.) temperatures. Salient features of the results of these tests are shown in FIGS. 49–52, from which the following findings are noted:

a. Tests correlated in FIGS. 49 and 50 show substantial improvements in alloy ductility and strength with RX2 processing for casual hydrogen embrittlement resistance, at both ambient and cryogenic (−110° F.) temperatures, respectively (see also FIG. 52).

b. FIG. 51, by comparison with FIGS. 49 and 50, suggests that the hydrogen pressure threshold for embrittlement is between 4 and 15 Torr at 1200° F. hydrogen exposure.

c. FIG. 52 shows absence of a cryogenic and hydrogen-assisted ductile-to-brittle transition with RX2 processing over both RX3 and RX4.

Figure 53:
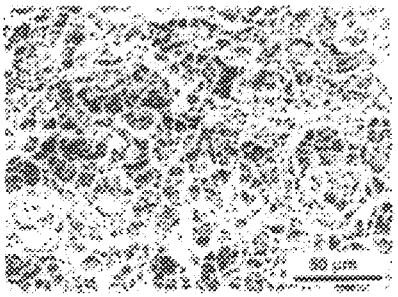
FIG. 53 shows the baseline fracture topography in uncharged RX2 alloy modification of Ti-6242S alloy tensile tested at room temperature showing a ductile void fracture mechanism.
Figure 54:
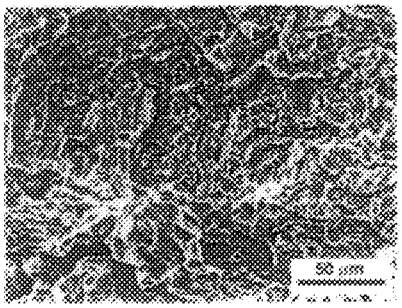
FIG. 54 shows fracture topography in heavily charged RX2 alloy modification of Ti-6242S alloy tensile tested at room temperature (precharged at 15 Torr $H_2$ at 1200° F. for 3 hours).
Figure 55:
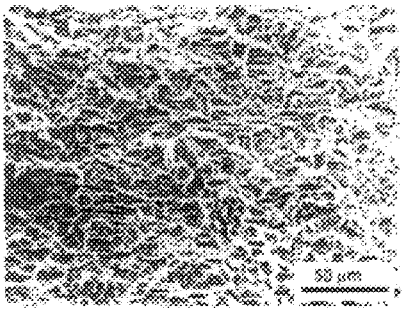
FIG. 55 shows fracture topography in moderately charged RX2 alloy modification of Ti-6242S (charged at a hydrogen pressure of 4 Torr and tested at room temperature).
Figure 56:
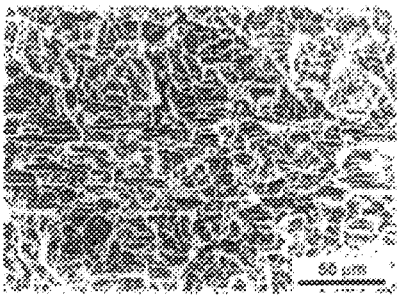
FIG. 56 shows fracture topography in moderately charged RX2 alloy modification of Ti-6242S (charged at a hydrogen pressure of 4 Torr and tested at −1100° F.).
Figure 57:
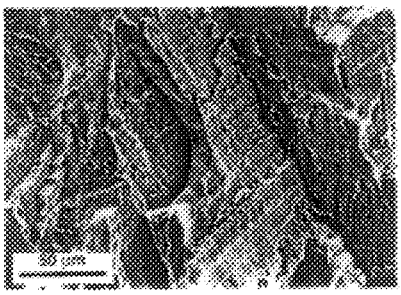
FIG. 57 shows fracture topography in moderately charged RX3 alloy modification of Ti-6242S (charged at a hydrogen pressure of 4 Torr, and then tensile tested at room temperature).
Figure 58:
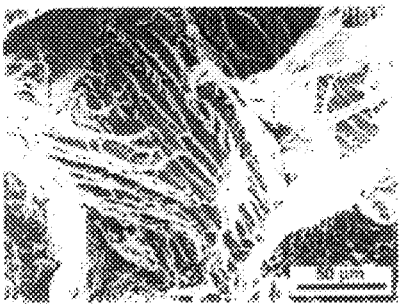
FIG. 58 shows fracture topography in moderately charged RX3 alloy modification of Ti-6242S (charged at a hydrogen pressure of 4 Torr, and then tensile tested at −110° F.)
Figure 59:
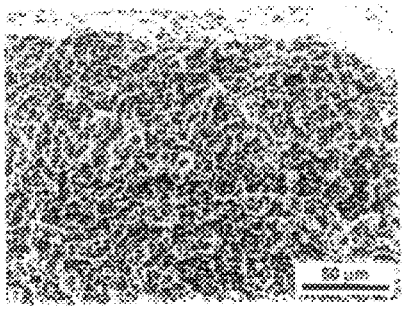
FIG. 59 shows fracture topography in moderately charged RX4 alloy modification of Ti-6242S (charged at a hydrogen pressure of 4 Torr, and then tensile tested at ambient conditions).
Figure 60:
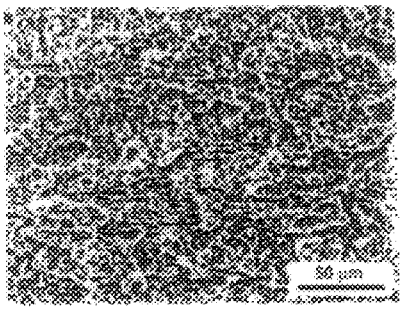
FIG. 60 shows fracture topography in moderately charged RX4 alloy modification of Ti-6242S (charged at a hydrogen pressure of 4 Torr, and then tensile tested at −110° F.)

The scanning electron microscope was used to gain some insight into the fracture mechanisms within hydrogen-charged modifications of Ti-6242S. First the baseline fracture topography (without hydrogen charging) was examined. it showed 100% ductile void fracture in the RX2 modification tested at room temperature (FIG. 53) which is consistent with the exhibited 12.5% elongation in that specimen. By contrast, the heavily charged specimen shown in FIG. 54 exhibited predominantly crystallographic microcleavage fracture in a tensile test following precharge at a hydrogen pressure of 15 Torr for 3 hours at 1200° F. This specimen exhibited zero elongation which indicates that the hydrogen threshold limit has been exceeded, and furthermore at high hydrogen concentrations, there is a tendency for hydrogen to segregate or migrate to certain crystallographic planes causing embrittlement as hydrides may precipitate therein. FIG. 55 shows the 4 Torr precharged RX2 tested at room temperature with an elongation of 10%. FIG. 56 shows a similarly processed specimen tested at −110° F. with essentially no change in topography as the elongation dropped slightly to 8.7%. FIG. 57 shows a dramatically different fracture topography in moderately charged RX3 tested at room temperature following a three-hour exposure at 1200° F. and 4-Torr hydrogen pressure. The observed elongation in this condition was as low as 3.5% at room temperature (FIG. 57) and dropped further to 2.5% upon testing at −110° F. In both cases, the failure path appears to follow some of the transformed alpha-beta platelet boundaries, but it mostly occurs along coarsened prior beta grain boundaries (FIGS. 57 and 58). FIG. 59 shows the predominant mechanism of fracture in moderately charged overaged RX4 modification of Ti-6242S alloy. With an associated elongation of 7.2%, the fracture appears to occur by a void mechanism following silicide particle populations. This modification exhibited severely embrittled behavior as the tensile test temperature was dropped from ambient to −110° F. with a concomitant drop in tensile elongation from 7.2% to 1.5% (FIG. 60).

In summary, the RX2 microstructure appears to be the most embrittlement-resistant modification of the Ti-6242S demonstrator alloy, both in terms of hydrogen and/or cryogenic temperature embrittlement. The superiority of RX2 microstructure over the beta annealed RX3 and/or the overaged RX4 microstructures appears to be related to the introduction of embrittlement-prone features of the latter two microstructures, such as prior beta grain boundaries and coarse plate habit planes (RX3) as well as silicide precipitate sheet boundaries (RX4).

(F) Improvement of Creep Resistance

Creep rupture tests were conducted according to the ASTM standard using the specimen geometry shown in FIG. 11 from 0.060 inch thick EDM cut and finish ground Ti-6242S sheet in three different modifications, RX1, RX2 and RX3. Two test environments were used in these studies: ultrapure argon and laboratory air.

Figure 61:
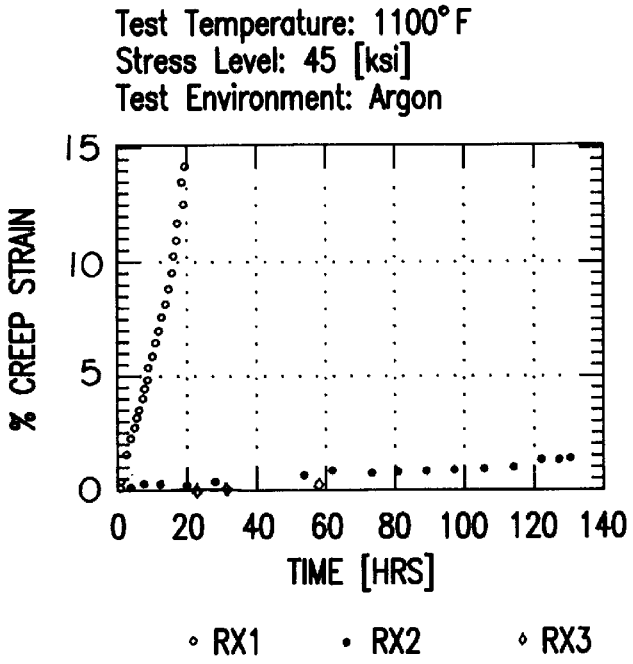
FIG. 61 is a comparison of creep rates in three modifications of Ti-6242S (RX1, RX2 and RX3) tested in argon at 1100° F. and 45 ksi.
Figure 62:
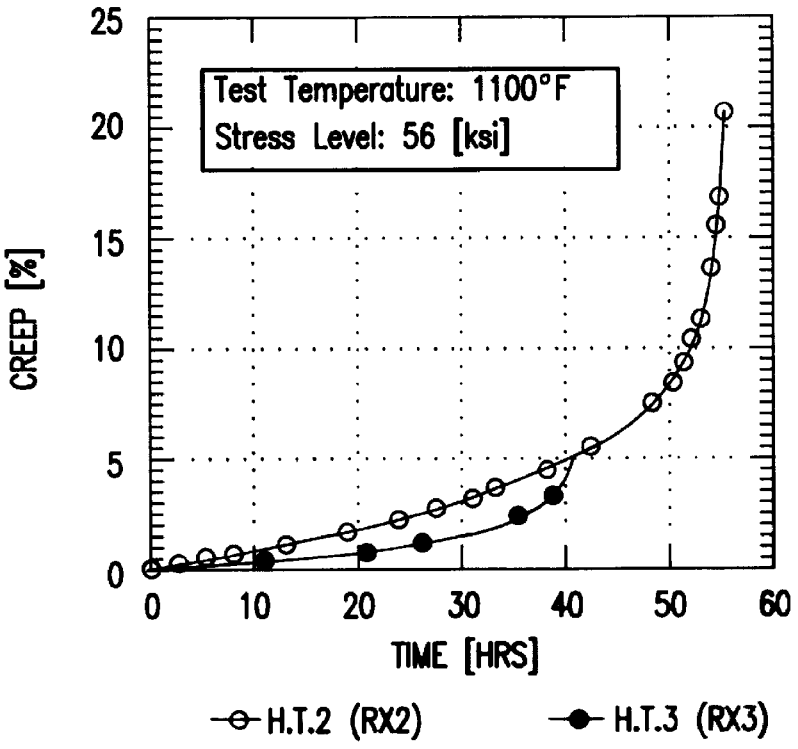
FIG. 62 illustrates the effect of heat treatment on creep rates in Ti6242S between subtransus-annealed and stabilized (HT2) and beta annealed and stabilized (HT3) microstructures tested in an air environment.
Figure 63:
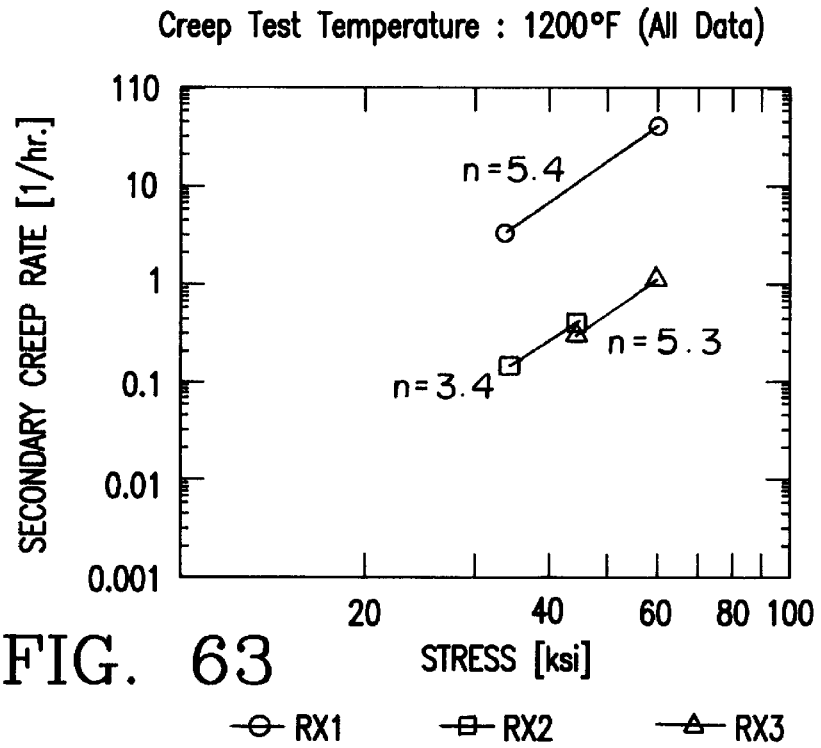
FIG. 63 presents a comparison of stress dependence of the secondary creep rates in three modifications of Ti-6242S (RX1, RX2 and RX3) tested in argon at 1200° F.

The highest creep resistance was exhibited by HT3 (FIG. 61), the supertransus (beta) annealed and stabilized at 1100° F. The creep resistance associated with this heat treatment was followed closely by that of the subtransus anneal and stabilize HT2 (FIG. 61 in argon and FIG. 62 in air). Although the secondary creep rate in HT2 (FIG. 62) was somewhat higher than that of the beta anneal HT3 material, the rupture life in HT2 was greater than that of the HT3 material.

In comparison with the duplex annealed heat treatment (HT1), the HT2 processing enhanced the material's creep resistance by nearly one order of magnitude (FIG. 61).

TABLE 9

Typical Primary Creep Measurements at Selected Stress-Temperature Combinations in Ti 62425 Alloy

| Heat Treatment (Modification) | Applied Stress (ksl) | Temperature (°F.) | $e_I$ (%) |
|---|---|---|---|
| HT1 (RX1) | 100 | 900 | 5.75 |
| HT2 (RX2)* | 100 | 900 | 0.75 |
| HT2 RX2 | 45 | 1,100 | 0.30 |
| HT3 (RX3) | 80 | 1,100 | 0.1 |
| HT3 (RX3) | 45 | 1,200 | 0.065 |
| HT1 (RX1) | 45 | 1,100 | 1.15 |

(G) Improvement of Fatigue Resistance

Figure 64:
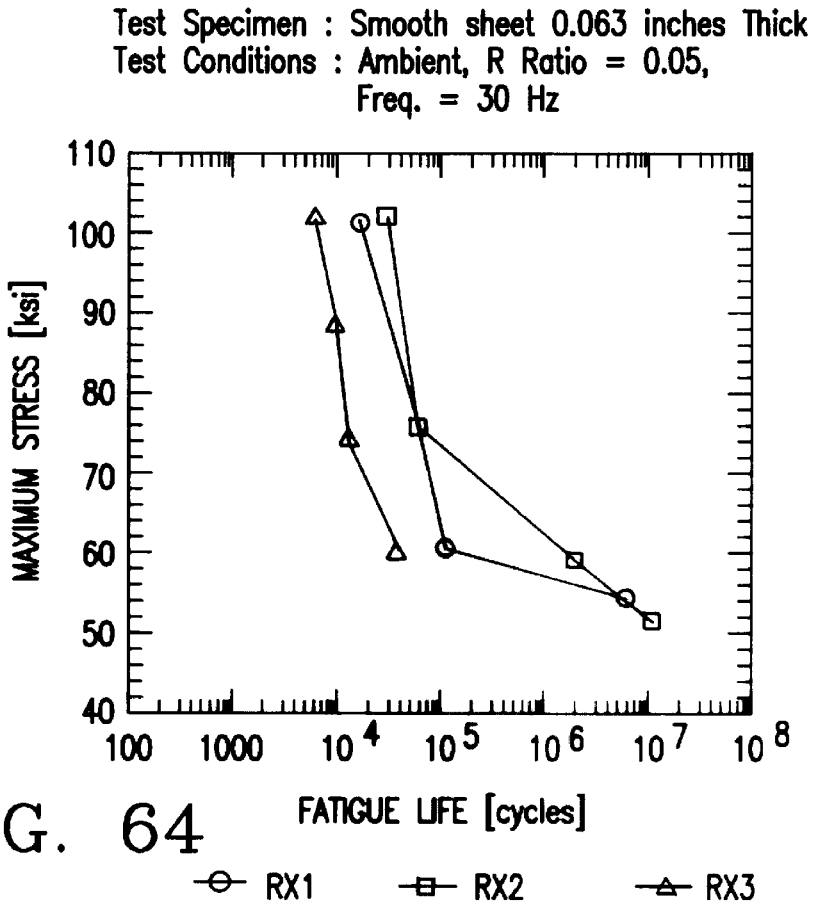
FIG. 64 presents a comparison of S/N fatigue behavior among three modifications of Ti-6242S (RX1, RX2 and RX5) tested at room temperature.

FIG. 64 shows the result of constant amplitude fatigue tests comparing three modification of Ti-6242S alloy, namely RX1, RX2, and RX5, or respectively mill duplex annealed subtransus annealed and stabilized and heat treated per MIL-H-81200 standard. The S/N curve plots correlate the number of cycles to failure with the maximum stress in a sinusoidal constant amplitude test at ambient temperature and environment. A test specimen having the geometry of that shown in FIG. 11 was used. The data in FIG. 64 shows the RX2 modification to be superior in fatigue relative to the MIL-H-81200 modification and is somewhat better than RX1. It is worth noting that the RX1 and RX2 modifications have virtually identical endurance limits of $10^7$ cycles.

In the foregoing discussion, several modifications of a typical alpha-beta alloy (Ti-6242S) were evaluated whereby one modification (RX2) showed a superior property set and the best optimized property balance for most applications.

TABLE 10

A Summary of RX2-Improved Properttes as Referenced in the Associated Figures and Tables Listed Below

| RX2 Improved Property | Associated References: Figure Numbers | Associated References: Table Numbers | Comments |
|---|---|---|---|
| Tensile Properties −200° F. to 1200° F. | 40, 41, 42, 43, 44 | 4, 6 | For temperatures from |
| Elastic Modulus average of 19.6 Msl | | 6, 7 | Obtained up to an |
| Thermal Stability | 45, 46, 47, 48 | | Up to 1200° F. |
| Resistance to Hydrogen Embrittlement | 49 Through 60 | | Tolerating over 200 ppm hydrogen |
| Fracture Toughness | | 8 | As high as 170 ksl inch |
| Creep Resistance | 61, 62, 63 | 9 | Up to 1100° F. |
| Fatigue S/N Curve | 6 4 | | Room Temperature Data |
| Resistance to Cryogenic Ductile-to-Brittle Transition | 44, | 50, 52 | Down to −110° F. in hydrogen, and −200° F. in air |

Secondary creep rates in air were faster by a factor of 2 to 2.5 in the average compared with rates in argon, but the same ranking of RX1, RX2 and RX3 remained unaltered in both environments. Similarly, without altering such ranking, the transverse test orientation showed somewhat weaker resistance to creep deformation than the longitudinal in the same alloy modification.

Finally, from a primary creep development standpoint, the three alloy modifications RX1, RX2 and RX3 followed the same ranking as shown in Table 9 below.

The RX2-improved properties are listed in Table 10 (preceding page). In summary, the following general highlights of each alloy modification are:

(a) The duplex-annealed condition (HT1)/RX1 showed highest ductility but lowest strength particularly at high temperature, coupled with relatively very poor creep resistance, very low fracture toughness, intermediate fatigue resistance and comparatively lower elastic modulus, but good thermal stability.

(b) The subtransus annealing (HT2)/RX2 showed moderately high tensile ductility acceptable for most engineering applications coupled with the highest strength level particularly at high temperature, excellent creep resistance (comparable to that of the beta-annealed condition HT3/RX3), superior hydrogen and cryogenic embrittlement resistances as well as best elastic modulus, best fatigue resistance, and good thermal stability (shown to be sufficient for HSCT applications).

(c) The beta annealing (HT3/RX3) showed a combination of low ductility and either intermediate or low strength, high creep resistance, but suffered embrittlement at cryogenic temperatures and generally exhibited poor thermal stability. Fracture toughness and fatigue behaviors were not characterized in this modification, but poor ductility is indicative, by inference, of low fracture toughness, and possibly poor low cycle fatigue.

(d) The overaged (1450° F. stabilized) condition (HT4/RX4) showed overage tensile properties, but poor cryogenic and hydrogen embrittlement resistances. Other properties (fracture toughness, creep and fatigue) were not characterized in this modification, but they are expected to be similar if not inferior to (HT1/RX1).

(e) The MIL-H-81200 heat treated condition (HT5/RX5) exhibited intermediate strength levels but poor low-cycle fatigue resistance, and relatively lower elastic modulus. Other properties were not characterized, but at least the fracture toughness is expected to be similar to that of (HT1/RX1), i.e., poor.

In all heat treatments, the transverse orientation exhibited a slightly reduced strength and, in most cases, slightly reduced ductility and reduced elastic modulus compared to the longitudinal orientation. The modulus reduction is believed to be a function of texture.

The general trends in elevated temperature strength and creep resistance among various heat treatments (or ranking) also remained the same over the temperature range examined (1000° F. to 1200° F.).

Figure 65:
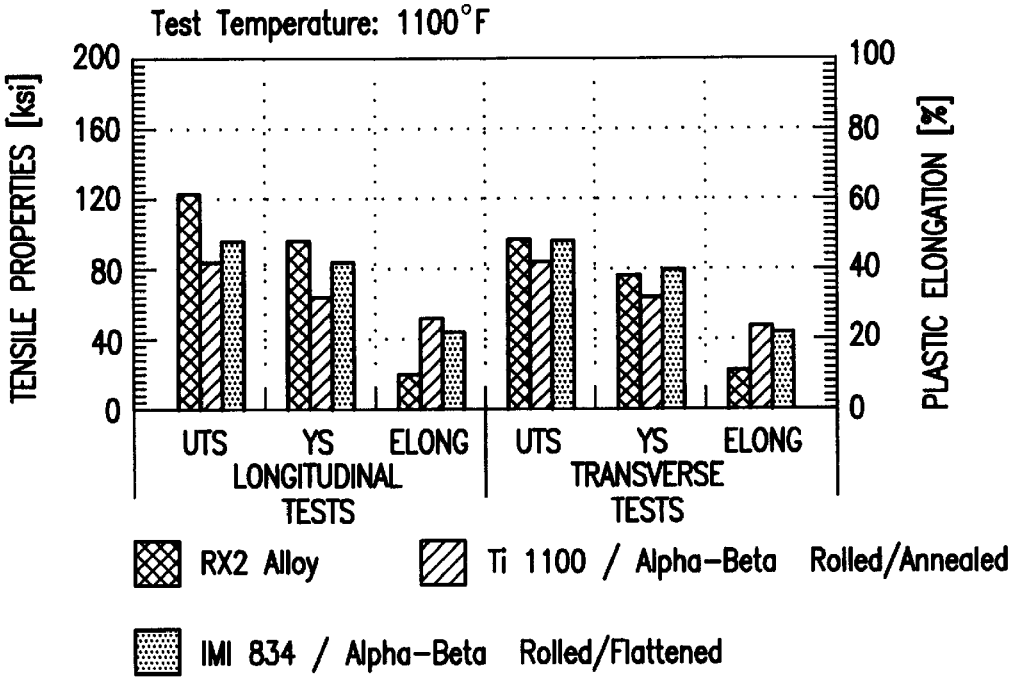
FIG. 65 presents a comparison of tensile strength behavior of RX2 alloy modification of Ti-6242S with Ti-1100 and IMI834 alloys at 1100° F.
Figure 66:
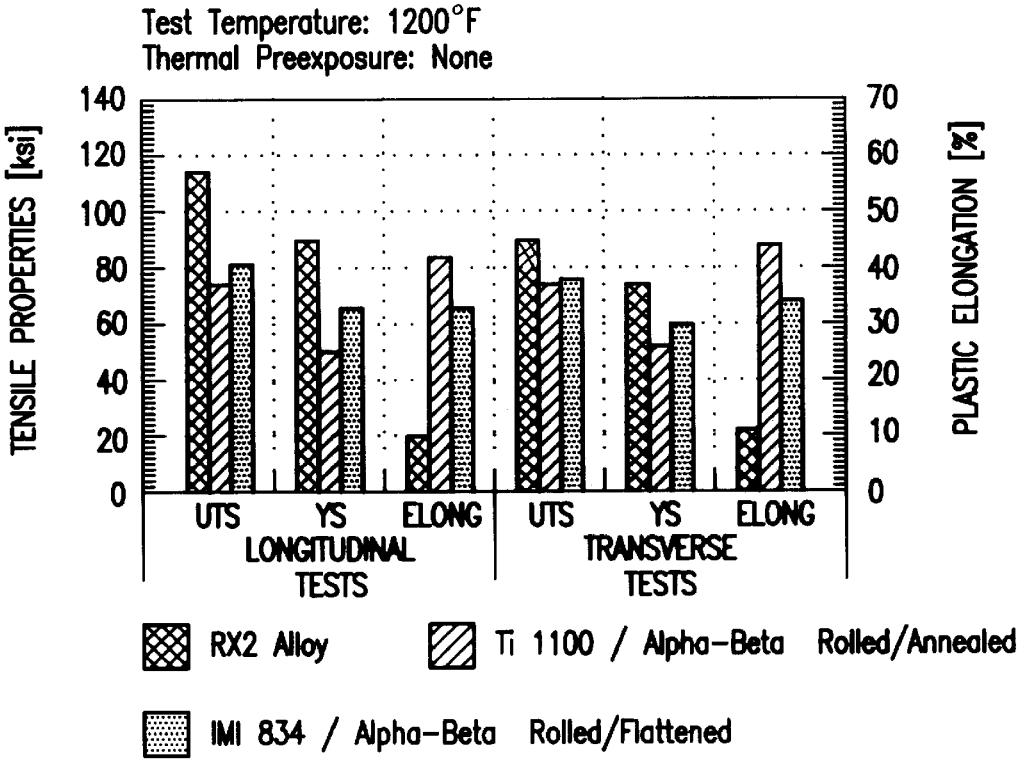
FIG. 66 presents a comparison of tensile strength behavior of RX2 alloy modification of Ti-6242S with Ti-1100 and IMI384 alloys at 1200° F.
Figure 67:
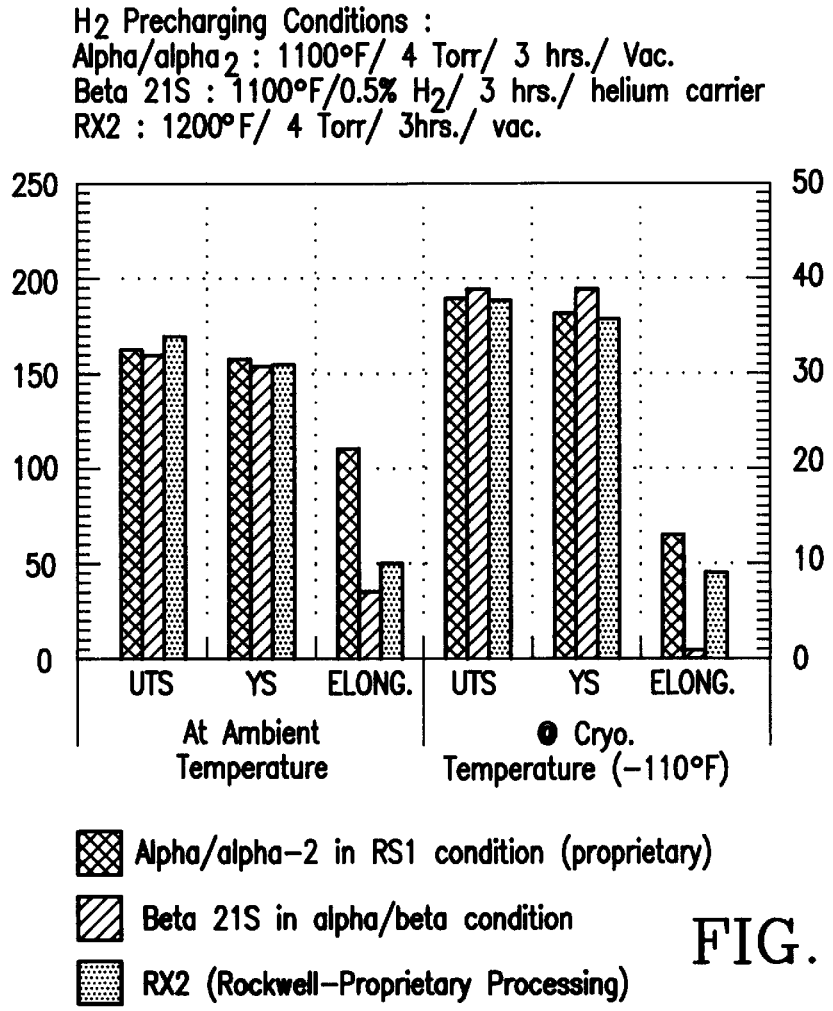
FIG. 67 presents a comparison of hydrogen-precharged tensile strength behavior of RX2 alloy modification of Ti-6242S with two advanced alloy systems: Beta 21S and alpha/alpha-2.

Comparison of the Optimized Modification RX2 with Other Advanced Titanium Alloys At 1100° F., the HT2 heat treatment exhibited UTS values as high as 123 ksi with a yield stress of 97 ksi and an elongation of 11%, a combination that is substantially better than the values reported at 1100° F. for either Ti-1100 and or IMI834 in both the as-received and beta-annealed conditions (FIG. 65). With the optimized heat treatment of Ti-6242S (HT2), the tensile strength properties were also higher than Ti-1100 and IMI834, even at 1200° F. combined with either equivalent or superior high-temperature ductility values (FIG. 66).

Also under relatively severe hydrogen charging conditions saturating the alloys with some 200 to 300 ppm H2 followed by tensile testing, the RX2 modification of Ti-6242S is superior to Beta 21S (a Ti metal alloy) and an alpha/alpha-2 alloy with the following composition:

Ti-8.5Al-5Nb-1Zr-1Mo-1V [wt. %] (see FIG. 65).

Figure 68:
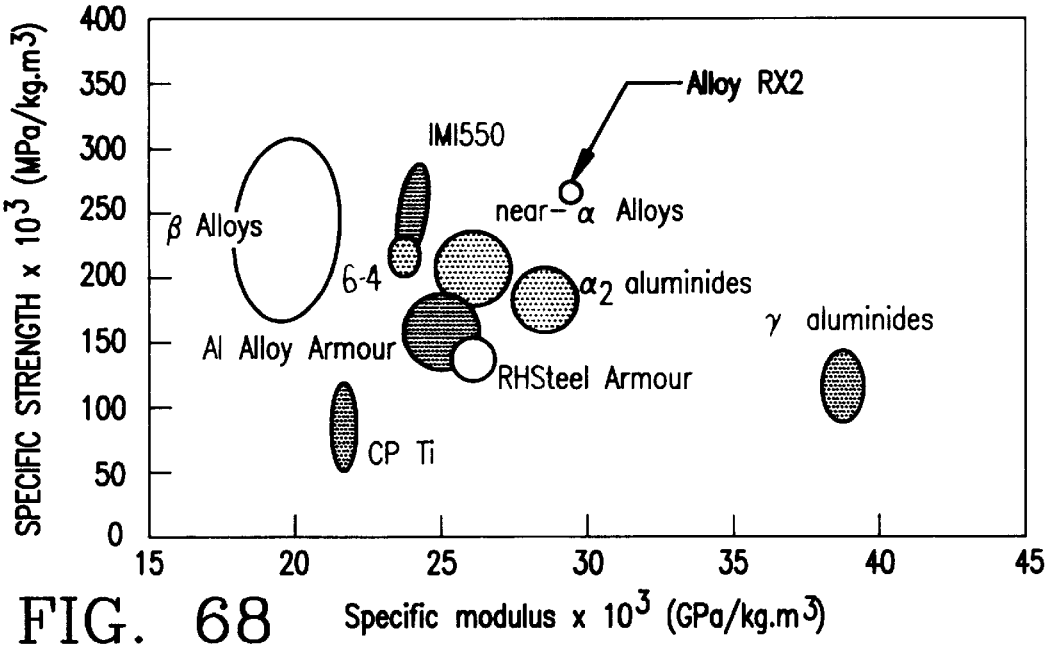
FIG. 68 is a graph showing several alloys for ballistic impact resistance in comparison with RX2 alloy modification of Ti-6242S.

Another area of interest is the resistance of the alloy to impact damage such as might occur during foreign object damage (FOD) or ballistic impact resistance. For these applications, the candidate alloy must exhibit a combination of high modulus, high strength and high fracture toughness. In ranking various alloys for this purpose, it is customary to cross plot any two of these three properties. As shown in FIG. 68, the RX2 is superior to most, if not all, of the reported candidate alloys for ballistic impact resistance.

Correlation of the RX2 Processing-Microstructure-Property Relationships

In the optimization of demonstrator alloy Ti-6242S, six initial microstructural transformations are primarily responsible for the mechanical property differences among the five alloy modifications studied. The six crucial processes may be described as follows:

(1) Cooling rates were slow enough in all heat treatments used (HT1 through HT5) so as to provide quasi-equilibrium phases in all cases.

(2) The initial state at the solution temperature of the beta phase versus alpha phase, and partial or total dissolution of precipitate.

(3) The volume proportions of the equiaxed versus Wiedmanstatten after cooling from the solution temperature and also the duplex versus triplex aspect of the fully transformed microstructure.

(4) Silicide precipitation as opposed to its retainment in solid solution.

(5) Silicide coarsening once it has precipitated.

(6) Precipitation of alpha-2 within the primary (equiaxed) alpha grains, and its morphology, distribution, and number density per unit volume.

A useful insight into the various combinations of the above six processes as they occurred per optical and transmission electron microscope observations may be glimpsed from the summary given in Table 11.

TABLE 11

Summary of Heat Treat Processing Relationship to Microstructures and Constituent Phase Distributions Among Five Modifications of the Demonstrator Alloy Ti 6242S

| TMP/HT Process Designation | Heat Treatment Summary | Alpha Phase Ordering | Alpha Phase Dislocations | Beta Phase Decomposition | Beta Phase Dislocations | Silicides | Comments |
|---|---|---|---|---|---|---|---|
| RX1/HT1 | 1650° F./30 min/AC then 1450° F./15 min/AC | None | Very few dislocations | Not decomposed | Very few dislocations | Small @ a/a grain boundaries (0.1 to 0.2 mm). Hex: a = 7.16° A c = 3.2° A | Final H.T. in air |
| RX2/HT2 | (RX1/HT1) + 1810° F./2 hrs./FC then | Ordered alpha-two precipitates | Very few dislocations | Decomposed | Moderate dislocation density | No obvious silicides | Final H.T. in vacuum |

TABLE 11-continued

Summary of Heat Treat Processing Relationship to Microstructures and Constituent Phase Distributions Among Five Modifications of the Demonstrator Alloy Ti 6242S

| TMP/HT Process Designation | Heat Treatment Summary | Alpha Phase Ordering | Alpha Phase Dislocations | Beta Phase Decomposition | Beta Phase Dislocations | Silicides | Comments |
|---|---|---|---|---|---|---|---|
| | 1100° F./8 hrs./FC | within the primary alpha phase | | | | | |
| RX3/HT3 | (RX1/HT1) + 1875° F./ 2 hrs/ FC then 1100° F./ 8 hrs/FC | none | Numerous dislocations | Not decomposed | Numerous dislocations | No obvious silicides | Final H.T. in vacuum |
| RX4/HT4 | (RX1/HT1) + 1450° F./ 4 hrs/FC | None | Some dislocations mostly in subbound-aries | Occasional small amount of alpha phase precipitates hut no omega | Very very few dislocations | Coarsened @ a/a boundaries (0.5 to 1.0 mm). Hex.: a = 7.16° A c = 3.2° A | Silicides are not $Ti_5Si_3$ Final H.T. in vacuum |
| RX5/HT5 | (RX1/HT1) + 1675° F./90 min/ argon-cool, then 1100° F./8 hrs./ argon cool | — | — | — | — | — | Microstructure not analysed in detail . . . , but similar to HT1 Final H.T. in argon |

A most important feature not included in Table 11 and one which could impact the fracture toughness and fatigue behavior of the alloy quite significantly is the volume proportions of lamellar (Wiedmanstatten) versus equiaxed phases in the various microstructures. While RX3 had nearly 100% lamellar microstructure, RX1, RX4 and RX5 had none. By contrast, RX2 had 47.44% equiaxed versus 52.56% lamellar (overaged over 30 fields). For all practical purposes in subsequent discussions, it will be assumed that these volume percents were 50% equiaxed/50% lamellar. Comparison of the microstructures in FIGS. 12, 21, 27 and 32 indicates that the fine thermomechanically processed alpha-beta microstructure was preserved in HT1, HT4 and HT5, whereas HT2 resulted in moderate coarsening of the mixed equiaxed/lamellar microstructure, and HT3 increased the prior beta grain size substantially, which resulted in a fully transformed beta microstructure.

With HT2 (or RX2) silicides did not precipitate at the 1100° F. age. However, they are an inherent microstructural feature of the duplex-anneal heat treatment, and they coarsen with prolonged aging at 1450° F. Thus with the 1100° F. age (or aging at lower temperatures), silicon remains totally in solution, primarily in the beta phase (see Table 11).

Data suggests that wherever suicides were present in the boundaries, there resulted poor fracture toughness, poor ductility, and poor cryogenic and hydrogen embrittlement behavior. By contrast, with suicides, the precipitation of alpha-2 with the equiaxed primary alpha phase occurred only in the case of HT2 (RX2). The creep resistance of RX2 was far superior to RX1 or HT1 which had no ordering. In this regard, HT4 and HT5, although not tested for creep, behaved similarly to HT1. The presence of ordered alpha-2 precipitates within the equiaxed alpha phase of RX2 considerably enhanced the creep resistance and high temperature strength of this alloy modification over all other modifications. In the past, the equiaxed phase without ordering has been blamed for poor creep resistance. The alpha-2 precipitate strengthening effect with the RX2 heat treatment is further reinforced with solid solution effects due to full retainment of silicon in solid solution during HT2. The dual beneficial effect due to lack of any silicides, on the one hand, and precipitate and solid solution strengthening on the other hand, provides the basis for simultaneous strengthening and toughening observed in the RX2 modification over all others, an improvement which spans apparently the entire temperature range from cryogenic temperatures to room temperatures to elevated temperatures.

Apart from the noted beneficial effects other features of the RX2 processing method brings about, some additional improvements are obtained.

First, the slow cooling for solution treatment at a rate in the range of (5 to 500)/min avoids the formation of metastable non-equilibrium phases, such as acicular martensites, thus providing for a reasonably stable microstructure, which can be stabilized further with the subsequent aging at a-temperature low enough (1000° F. to 1100° F.) to avoid the precipitation of any silicides. This continuous but slow cooling process in the above-mentioned range appears to be still too fast for any silicides to precipitate during continuous cool down from solution temperature, as verified by transmission electron microscopy of various modifications. The absence of metastable phases explains why the final microstructure was quite stable in RX2.

Secondly, the presence of some residual beta phase and the triplex feature due to fine transformed patches of prior beta may account for some added beneficial effects on alloy ductility and fracture toughness of the RX2 modification, unlike all other.

Thirdly, elastic modulus enhancement is most likely the result of a combined composite stiffening process at the microscopic and submicroscopic levels. Composite stiffening is thought to be due to 50% Wiedmanstatten+50% equiaxed primary alpha phase (microscopic scale). Stiffening of the primary alpha phase is thought to be due to numerous ordered alpha-2 precipitate praritcles (submicroscopic scale). And the solid solution effect is thought to be due to full retainment of silicon-within both the alpha and beta phases (atomic-scale stiffening at the cohesive atomic bond strength level).

Figure 69:
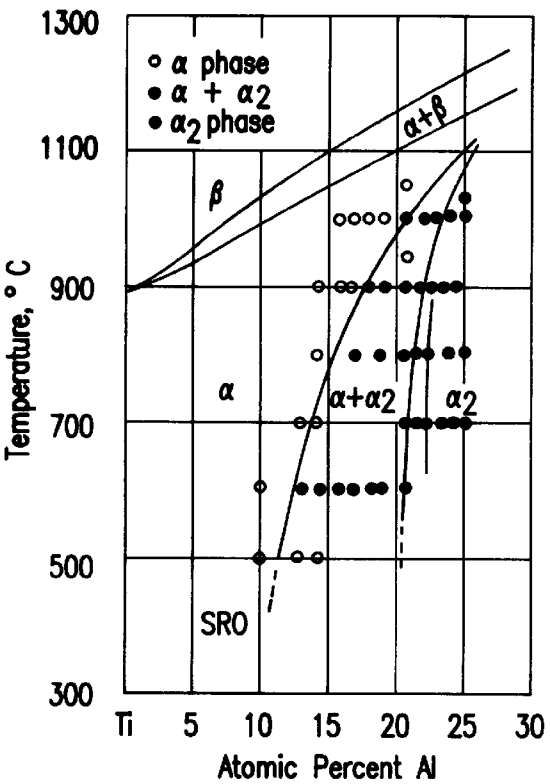
FIG. 69 is a partial Ti—Al equilibrium phase diagram for the range 0 at. % Al to 25 at. % Al.

Finally it is simportant to understand how it is that only the TMP/HT RX2 processing method was capable of introducing alpha-2 precipitates within the primary alpha phase, whereas all other modifications failed to show any evidence of alpha-2 precipitation. To shed show light on this important and unique aspect of the RX2 optimization, reference should be made to the phase diagram of FIG. 69 and the data presented in Table 12 below.

TABLE 12

Composition of the component Phases in Wiedmanstatten $\alpha + \beta$ Phase Ti 6242

| | Composition in Wt. % (at. %) | | | | |
|---|---|---|---|---|---|
| Component | Ti | AI | Sn | Zr | Mo |
| Average- | 86 (85) | 6 (11) | 2 (1) | 4 (2) | 2 (1) |
| $\beta$ platelet** | 78.5 (87) | 0.5 (1) | 2.0 (1) | 4.0 (2) | 15.0 (8) |
| $\alpha$ platelet** | 88.5 (88) | 5.0 (8) | 2.0 (1) | 4.0 (2) | 0.5 (<1) |

*Nominal composition.
**STEM/EDAX analysis.

In order to introduce ordering (alpha-2 precipitates) in alpha-beta alloys, Blackburn originally suggested that the alloy must contain 12 to 25 atoms percent aluminum. Furthermore, the phase diagram shown in FIG. 69 suggests that in order for any alpha-2 to precipitate at 1675° F., 1650° F. or 1450° F. (which are the exposure temperatures for HT1 (RX1), HT4/RX4, and HT5/(RX5)—787° C. to 912° C. in FIG. 69), at least 15 to 18 atomic percent aluminum must be available withint the average microstructural constituent and at least within the primary alpha phase. Table 12 shows that such a severe partitioning of aluminum is very unlikely to occur in Ti-6242S, which has an average concentration of 6 wt. % or 11 atomic % aluminum. As the heat treater drops the aging temperature level to lower values, as for example in the range of from 1000° F. to 1100° F. (about 537° C. to 593° C.), the minimum required concentration of aluminum also drops to about 12–13 atomic %. In the modification of the Ti-6242S alloy at the solution temperature (very near beta transus), the resulting phase proportions are such that 50% by volume is Widmanstatten and 50% is equiaxed primary alpha. As shown in Table 9, aluminum partitions less to the Widmanstatten alpha+beta phase than the average concentration within the Ti-6242S alloy (8% in alpha platelets+1% in the beta platelets, as opposted to 11% average overall). Therefore, the more aluminum that partitions to the equiaxed alpha phase than the average 11% atm. in order to maintain a two-phase average of 11% with a 50% equiaxed/50% Widmanstatten, the greater the likelihood that a partitioned concentration of 13 atm. % in the equiaxed primary alpha phase can be achieved.

Under these conditions, precipitation of alpha-2 is found to be favorable, and as the precipitation commences, it yields ordered and disordered (aluminum rich and lean) domains, respectively. With continued hold at the aging temperature, aluminum diffuses in and redistibutes itself to maintain equilibrium conditions. As the temperature is further dropped and the materials cool in vacuum (at about (5° F. to 500° F.)/min., the $\alpha_2$ precipitate size, morphology and coherency will be affected. At the same time, no precipitation of $\alpha_2$ within the Widmanstatten phase is favorable, as discussed above and as shown by transmission microscopy (see FIG. 26).

The above-described mode of ordered alpha-2 precipitation reaction is not obvious or easy to achieve in practice in view of the brittle nature of the bianry stoichiometric alpha-2 (based on $Ti_3Al$ phase) which could rapidly cause embrittlement of the matrix phase rather than strengthen it at concentration anywhere above 12 atomic %. The mode of RX2 control of the entire heat treat process appears to have achieve a first in that the resulting morphology, distribution, size and coherency of the alpha-2 phase with the primary alpha phase allows for dislocation bypass (looping) which maintains a reasonable degree of alloy ductility while aviodding the previously termed "inevitable alpha-2 $Ti_3Al$ particle embrittlement" mechanism.

TABLE 13

Correlation of Projected Typical Titanium Alloy Goal Properties for Mach 2.4 HSCT with Properties of Alloy Modification RX2

| Alloy Type | Applicable Product Forms | Ultimate Tensile Strength [ksi] | Fracture Toughness Kapp [ksi/in] | Fracture Toughness Klc [ksi/in] | Elastic Tension Modulus [Msi] | Density [lbs/in$^3$] |
|---|---|---|---|---|---|---|
| High-strength Alloy Goal Requirement | Foil, Strip, Sheet, Plate, Forging, Extrusion | 210 | 100 | 60 | 16.0 | 0.167 |
| High-toughness Alloy Goal Requirement | Foil, Strip, Sheet, Plate, Forging, Extrusion | 165 | 190 | 95 | 16.5 | 0.162 |
| High-Modulus Alloy Goal Requirement | Strip, Sheet, Plate, Extrusion | 145 | 160 | 80 | 19.5 | 0.159 |
| Invention's Alloy Modification RX2 Average Properties | Sheet, Strip | 166 | 170.4 | Not applicable | 19.6 | 0.165 |

Figure 70:
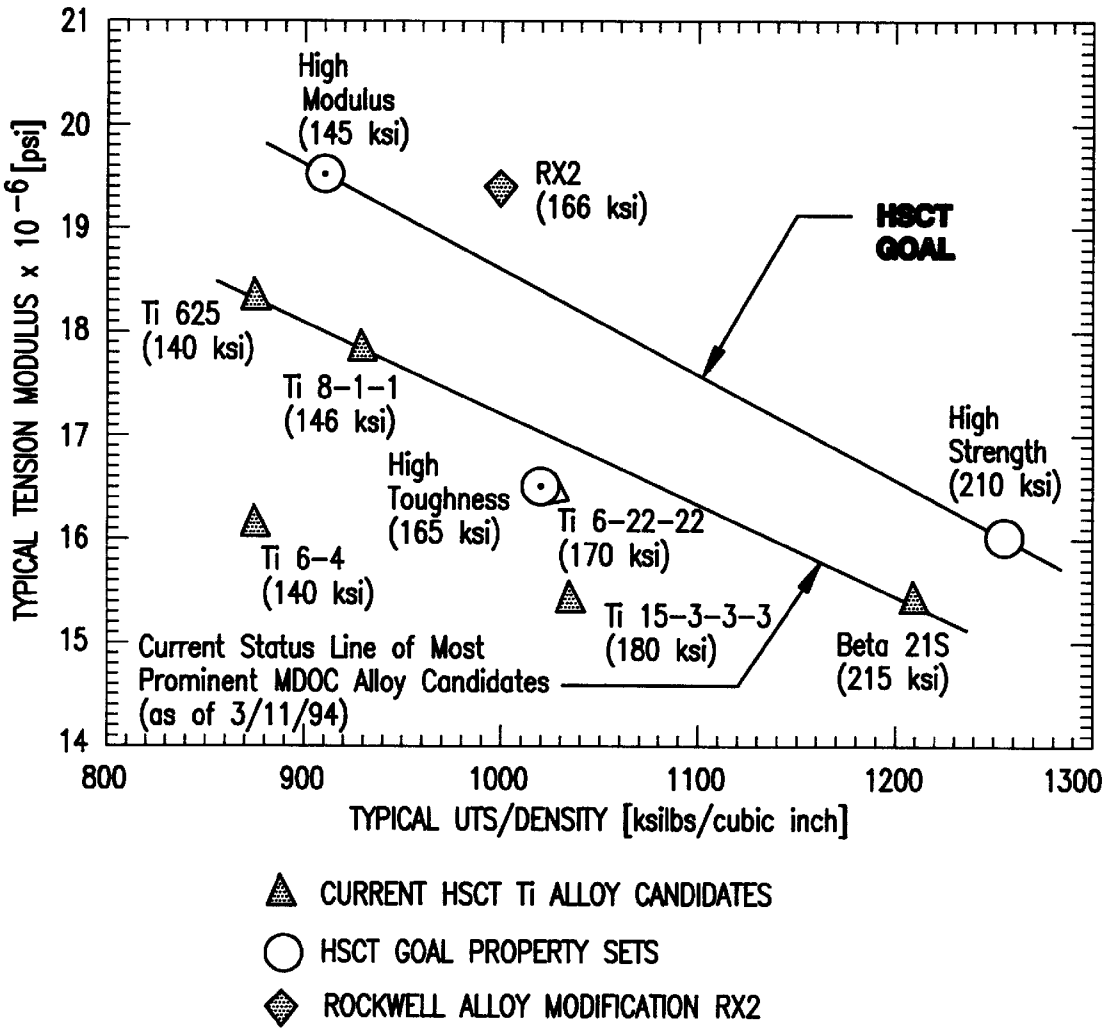
FIG. 70 depicts the correlation of titanium alloy modification RX2 with current HSCT program alloys and required elastic tension modulus goals.

Various applications of the RX2 optimization methodology are contemplated. Table 13 correlates the RX2 alloy properties with the High Speed Civil Transport objectives showing that the optimized alloy meets the HSCT high modulus alloy requirements (see FIG. 70). This methodology is also applicable to the development of advanced titanium alloys for hypersonic vehicles, and for structures requiring high resistance to ballistic impact.

Obviously, many modifications and variations of the present invention are possible in light of the above teachings. It is, therefore, to be understood that within the scope of the appended claims, the invention may be practiced otherwise than as specifically described.

What is claimed and desired to be secured by letters Patent of the United States is:

1. A composition of matter comprising a titanium alloy having an ($\alpha$+$\alpha$2+$\beta$) microstructure, and having improved fracture toughness and tensile strength as compared with mill-processed ($\alpha$+$\beta$) titanium alloy.

2. The composition of matter of claim 1, wherein said ($\alpha$+$\alpha_2$+$\beta$) microstructure consists of equiaxed alpha phase strengthened with $\alpha_2$ precipitates coexisting with lamellar alpha-beta phase, where the $\alpha_2$ precipitates are confined totally to the equiaxed primary alpha phase.

* * * * *